US012152308B2

(12) United States Patent
Mikami et al.

(10) Patent No.: US 12,152,308 B2
(45) Date of Patent: Nov. 26, 2024

(54) METHOD FOR PRODUCING FLUORINE GAS AND DEVICE FOR PRODUCING FLUORINE GAS

(71) Applicant: SHOWA DENKO K.K., Tokyo (JP)

(72) Inventors: Katsumi Mikami, Tokyo (JP); Yohsuke Fukuchi, Tokyo (JP); Hiroshi Kobayashi, Tokyo (JP)

(73) Assignee: Resonac Corporation, Tokyo (JP)

( * ) Notice: Subject to any disclaimer, the term of this patent is extended or adjusted under 35 U.S.C. 154(b) by 564 days.

(21) Appl. No.: 17/613,865

(22) PCT Filed: Dec. 11, 2020

(86) PCT No.: PCT/JP2020/046387
§ 371 (c)(1),
(2) Date: Nov. 23, 2021

(87) PCT Pub. No.: WO2021/131815
PCT Pub. Date: Jul. 1, 2021

(65) Prior Publication Data

US 2022/0213605 A1 Jul. 7, 2022

(30) Foreign Application Priority Data

Dec. 27, 2019 (JP) ..... 2019-238476

(51) Int. Cl.
*C25B 15/023* (2021.01)
*C25B 1/245* (2021.01)
(Continued)

(52) U.S. Cl.
CPC ..... *C25B 15/023* (2021.01); *C25B 1/245* (2013.01); *C25B 9/17* (2021.01); *C25B 11/043* (2021.01); *C25B 15/08* (2013.01)

(58) Field of Classification Search
CPC ..... C25B 1/245; C25B 15/023
See application file for complete search history.

(56) References Cited

U.S. PATENT DOCUMENTS

2012/0228144 A1* 9/2012 Pernice ..... C01B 7/20 204/243.1
2013/0032471 A1 2/2013 Yao et al.
2015/0292092 A1* 10/2015 Yao ..... C25B 1/245 204/246

FOREIGN PATENT DOCUMENTS

JP 2004353015 A * 12/2004 ..... C25B 1/245
JP 2011-038145 A 2/2011
(Continued)

OTHER PUBLICATIONS

International Search Report dated Feb. 16, 2021 from the International Searching Authority in International Application No. PCT/JP2020/046387.
(Continued)

*Primary Examiner* — Alexander W Keeling
(74) *Attorney, Agent, or Firm* — Sughrue Mion, PLLC

(57) ABSTRACT

A method for producing fluorine gas including electrolyzing an electrolyte in an electrolytic cell, measuring the average particle size of a mist contained in a fluid generated in the inside of the electrolytic cell in the electrolyzing the electrolyte, and sending the fluid from the inside to the outside of the electrolytic cell through a flow path. The flow path in which the fluid flows is switched in accordance with the average particle size of the mist measured in the measuring the average particle size, such that the fluid is sent to a first flow path when the average particle size of the mist measured in the measuring the average particle size is not more than a predetermined reference value, or the fluid is sent to a second flow path when the average particle size is more than the predetermined reference value.

8 Claims, 15 Drawing Sheets

(51) Int. Cl.

| | |
|---|---|
| ***C25B 9/17*** | (2021.01) |
| ***C25B 11/043*** | (2021.01) |
| ***C25B 15/08*** | (2006.01) |

(56) References Cited

FOREIGN PATENT DOCUMENTS

| | | | |
|---|---|---|---|
| JP | 2011-225922 | A | 11/2011 |
| JP | 2013-507629 | A | 3/2013 |
| JP | 5584904 | B2 | 9/2014 |
| JP | 5919824 | B2 | 5/2016 |
| TW | 201311935 | A1 | 3/2013 |

OTHER PUBLICATIONS

International Preliminary Report on Patentability dated Jun. 28, 2022, with translation of Written Opinion issued in International Application No. PCT/JP2020/046387.

* cited by examiner

METHOD FOR PRODUCING FLUORINE GAS AND DEVICE FOR PRODUCING FLUORINE GAS

CROSS REFERENCE TO RELATED APPLICATIONS

This application is a National Stage of International Application No. PCT/JP2020/046387 filed Dec. 11, 2020, claiming priority based on Japanese Patent Application No. 2019-238476 filed Dec. 27, 2019.

TECHNICAL FIELD

The present invention relates to a method for producing fluorine gas and a device for producing fluorine gas.

BACKGROUND ART

Fluorine gas can be synthesized (electrolytically synthesized) by electrolyzing an electrolyte containing hydrogen fluoride and a metal fluoride. Electrolyzing an electrolyte generates mist (for example, a mist of the electrolyte) together with fluorine gas, and thus the fluorine gas sent from an electrolytic cell is accompanied with mist. The mist accompanying fluorine gas becomes fine particles, which may clog pipes and valves used to send fluorine gas. This may force a production operation of fluorine gas to discontinue or stop and has interfered with continuous operation to produce fluorine gas by the electrolytic method.

To suppress clogging of pipes and valves with mist, PTL 1 discloses technology of heating fluorine gas accompanied with mist or a pipe through which the gas passes, to a temperature equal to or higher than the melting point of an electrolyte. PTL 2 discloses a gas production device including a gas diffusion unit as a space to roughly collect mist and a filler storage unit storing a filler for adsorbing mist.

CITATION LIST

Patent Literature

PTL 1: JP 5584904 B
PTL 2: JP 5919824 B

SUMMARY OF INVENTION

Technical Problem

There is still a demand for technology capable of more efficiently suppress clogging of pipes and valves with mist.

The present invention is intended to provide a method for producing fluorine gas and a device for producing fluorine gas capable of suppressing clogging of pipes and valves with mist.

Solution to Problem

To solve the problems, aspects of the present invention are the following [1] to [5].

[1] A method for producing fluorine gas, the fluorine gas being produced by electrolyzing an electrolyte containing hydrogen fluoride and a metal fluoride, the method including electrolyzing the electrolyte in an electrolytic cell, measuring an average particle size of a mist contained in a fluid generated in an inside of the electrolytic cell in the electrolyzing the electrolyte, and sending the fluid from the inside to an outside of the electrolytic cell through a flow path.

In the method for producing fluorine gas, in the sending, the flow path in which the fluid flows is switched in accordance with the average particle size of the mist measured in the measuring an average particle size, such that the fluid is sent to a first flow path that sends the fluid from the inside of the electrolytic cell to a first outside when the average particle size of the mist measured in the measuring an average particle size is not more than a predetermined reference value, or the fluid is sent to a second flow path that sends the fluid from the inside of the electrolytic cell to a second outside when the average particle size is more than the predetermined reference value, and the predetermined reference value is a numerical value of 0.1 μm or more and 1.0 μm or less.

[2] The method for producing fluorine gas according to the aspect [1], in which the metal fluoride is a fluoride of at least one metal selected from the group consisting of potassium, cesium, rubidium, and lithium.

[3] The method for producing fluorine gas according to the aspect [1] or [2], in which an anode used in the electrolyzing is a carbonaceous electrode formed from at least one carbon material selected from the group consisting of diamond, diamond-like carbon, amorphous carbon, graphite, and glassy carbon.

[4] The method for producing fluorine gas according to any one of the aspects [1] to [3], in which the electrolytic cell has a structure in which bubbles generated on the anode or a cathode used in the electrolyzing are capable of rising vertically in the electrolyte to reach a surface of the electrolyte.

[5] A device for producing fluorine gas, the fluorine gas being produced by electrolysis of an electrolyte containing hydrogen fluoride and a metal fluoride, the device including an electrolytic cell storing the electrolyte and configured to perform the electrolysis, an average particle size measurement unit configured to measure an average particle size of a mist contained in a fluid generated in an inside of the electrolytic cell during the electrolysis of the electrolyte, and a flow path configured to send the fluid from the inside to an outside of the electrolytic cell.

In the device for producing fluorine gas, the flow path includes a first flow path configured to send the fluid from the inside of the electrolytic cell to a first outside and a second flow path configured to send the fluid from the inside of the electrolytic cell to a second outside and includes a flow path switching unit configured to switch the flow path in which the fluid flows, to the first flow path or the second flow path in accordance with the average particle size of the mist measured by the average particle size measurement unit, the flow path switching unit is configured to send the fluid from the inside of the electrolytic cell to the first flow path when the average particle size of the mist measured by the average particle size measurement unit is not more than a predetermined reference value, or to send the fluid from the inside of the electrolytic cell to the second flow path when the average particle size is more than the predetermined reference value, and the predetermined reference value is a numerical value of 0.1 μm or more and 1.0 μm or less.

Advantageous Effects of Invention

According to the present invention, clogging of pipes and valves with mist can be suppressed when an electrolyte containing hydrogen fluoride and a metal fluoride is electrolyzed to produce fluorine gas.

DESCRIPTION OF EMBODIMENTS

Figure 1:
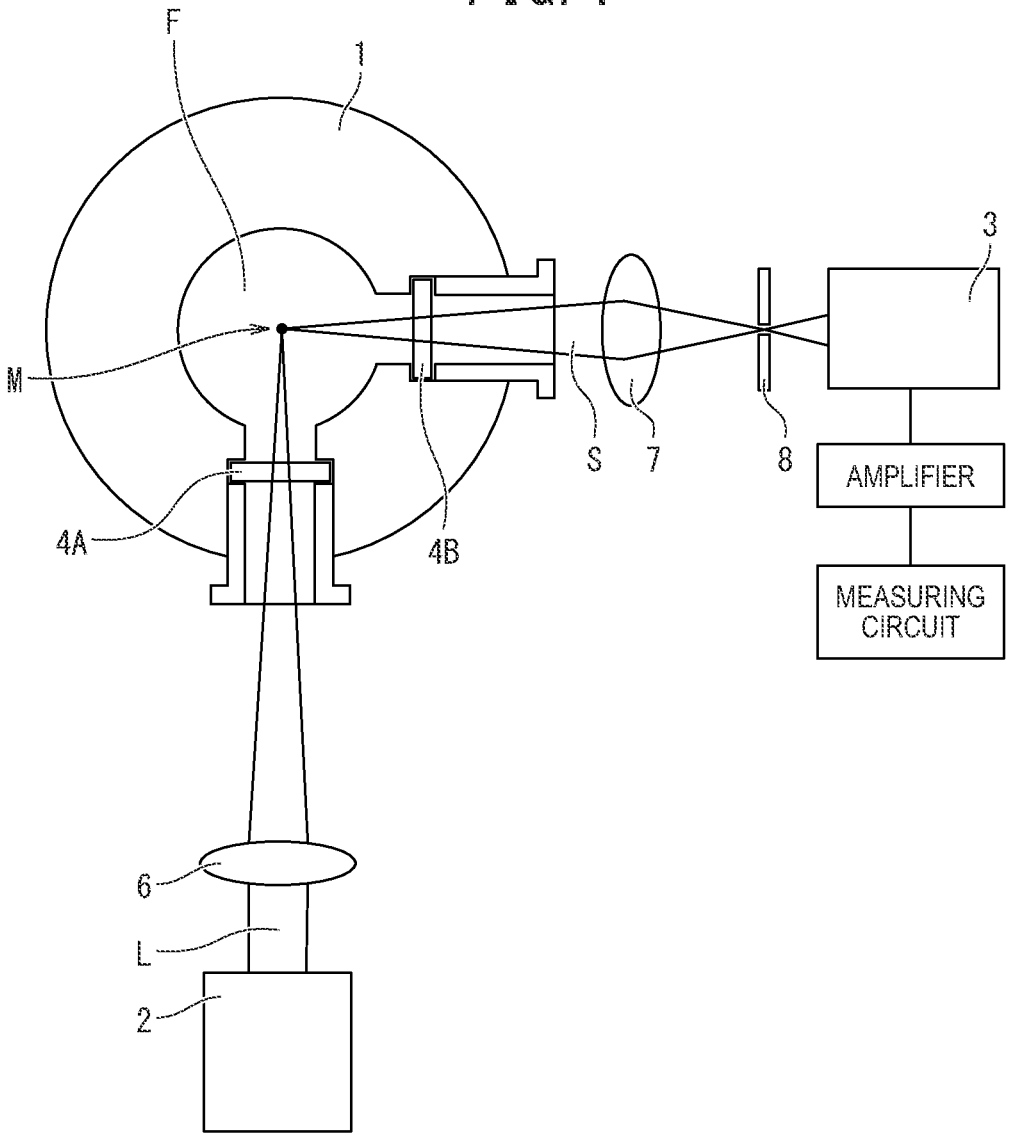
FIG. 1 is a view schematically illustrating an example light scattering detector used as an average particle size measurement unit in a device for producing fluorine gas pertaining to an embodiment of the present invention.

Embodiments of the present invention will now be described. The embodiments are merely examples of the present invention, and the present invention is not limited to the embodiments. Various modifications or improvements can be made in the embodiments, and such modifications and improvements can be encompassed by the present invention.

The inventors of the present invention have conducted intensive studies on a mist that causes clogging of pipes or valves in electrolytic synthesis of fluorine gas. In the present invention, a "mist" is liquid microparticles or solid microparticles generated together with fluorine gas in an electrolytic cell by electrolysis of an electrolyte. Specifically, a mist is microparticles of an electrolyte, solid microparticles formed by phase change of microparticles of an electrolyte, and solid microparticles generated by reaction of fluorine gas with members included in an electrolytic cell (for example, metals included in an electrolytic cell, gaskets for an electrolytic cell, and a carbon electrode).

The inventors of the present invention have measured the average particle size of a mist contained in a fluid generated in an electrolytic cell during electrolysis of an electrolyte and have found that the average particle size of the mist changes with time. As a result of intensive studies, the inventors of the present invention have also found a relation between average particle size of a mist and likelihood of clogging of pipes and valves that send a fluid. The inventors of the present invention have found that the clogging of pipes and valves can be suppressed by improving a flow path for sending a fluid generated in an electrolytic cell in accordance with the average particle size of a mist, and the frequency of discontinuance or stop of an operation for producing fluorine gas can be reduced and have completed the present invention. Embodiments of the present invention will now be described.

A method for producing fluorine gas in an embodiment is a method for producing fluorine gas by electrolyzing an electrolyte containing hydrogen fluoride and a metal fluoride. The method includes electrolyzing the electrolyte in an electrolytic cell, measuring the average particle size of a mist contained in a fluid generated in the inside of the electrolytic cell in the electrolyzing the electrolyte, and sending the fluid from the inside to the outside of the electrolytic cell through a flow path.

In the sending, the flow path in which the fluid flows is switched in accordance with the average particle size of the mist measured in the measuring the average particle size. In other words, the fluid is sent to a first flow path that sends the fluid from the inside of the electrolytic cell to a first outside when the average particle size of the mist measured in the measuring the average particle size is not more than a predetermined reference value, or the fluid is sent to a second flow path that sends the fluid from the inside of the electrolytic cell to a second outside when the average particle size is more than the predetermined reference value. The predetermined reference value is a numerical value of 0.1 μm or more and 1.0 μm or less.

A device for producing fluorine gas in an embodiment is a device for producing fluorine gas by electrolysis of an electrolyte containing hydrogen fluoride and a metal fluoride. The device includes an electrolytic cell storing the electrolyte and configured to perform the electrolysis, an average particle size measurement unit configured to measure the average particle size of a mist contained in a fluid generated in the inside of the electrolytic cell during the electrolysis of the electrolyte, and a flow path configured to send the fluid from the inside to the outside of the electrolytic cell.

The flow path includes a first flow path configured to send the fluid from the inside of the electrolytic cell to a first outside and a second flow path configured to send the fluid from the inside of the electrolytic cell to a second outside. The flow path also includes a flow path switching unit configured to switch the flow path in which the fluid flows, to the first flow path or the second flow path in accordance with the average particle size of a mist measured by the average particle size measurement unit.

The flow path switching unit is configured to send the fluid from the inside of the electrolytic cell to the first flow path when the average particle size of a mist measured by the average particle size measurement unit is not more than a predetermined reference value, or to send the fluid from the inside of the electrolytic cell to the second flow path when the average particle size is more than the predetermined reference value. The predetermined reference value is a numerical value of 0.1 μm or more and 1.0 μm or less.

In the method for producing fluorine gas and the device for producing fluorine gas of the embodiments, the flow path in which the fluid flows is switched to the first flow path or the second flow path in accordance with the average particle size of a mist, and thus the mist is unlikely to cause clogging of the flow paths. Hence, the method for producing fluorine gas and the device for producing fluorine gas of the embodiments can suppress the clogging of pipes and valves with mist when an electrolyte containing hydrogen fluoride and a metal fluoride is electrolyzed to produce fluorine gas. This can reduce the frequency of discontinuance or stop of an operation for producing fluorine gas and facilitates continuous operation. As a result, fluorine gas can be economically produced.

In the method for producing fluorine gas and the device for producing fluorine gas of the embodiments, the average particle size measurement may be performed for only the mist contained in a fluid generated on the anode or for both the mist contained in a fluid generated on the anode and the mist contained in a fluid generated on the cathode. The average particle size measurement may be performed continuously, periodically at regular intervals, or irregularly at any time during electrolysis. The first flow path differs from the second flow path, but the first outside and the second outside may be different sections or the same section.

Examples of the method for producing fluorine gas and the device for producing fluorine gas of the embodiments will be described. The first flow path is a flow path through which a fluid is sent from the inside of the electrolytic cell through a mist removal unit for removing a mist from the fluid to a fluorine gas selection unit for selectively collecting fluorine gas from the fluid. The second flow path is a flow path through which a fluid is sent from the inside of the electrolytic cell to the fluorine gas selection unit but not through the mist removal unit. In other words, a fluid is sent to the mist removal unit on the first flow path when the average particle size of a mist is not more than a predetermined reference value, and a fluid is not sent to the mist removal unit when the average particle size is more than the predetermined reference value. In the present example, the fluorine gas selection unit corresponds to the first outside and the second outside, and the first outside and the second outside are the same section, but the first outside and the second outside may be different sections.

The second flow path has a clogging suppression mechanism that suppresses the clogging of the second flow path with mist. The clogging suppression mechanism may be any mechanism that can suppress the clogging of the second flow path with mist, and examples include the following mechanisms. In other words, examples include a pipe having a large diameter, an inclined pipe, a rotary screw, and an airflow generator, and these members may be used in combination.

In particular, when the second flow path at least partially includes a pipe having a larger diameter than the first flow path, the clogging of the second flow path with mist can be suppressed. Alternatively, when the second flow path at least partially includes a pipe that is inclined relative to the horizontal direction and extends downward from the upstream side to the downstream side, the clogging of the second flow path with mist can be suppressed.

When a rotary screw for sending a mist deposited in the second flow path to the upstream side or the downstream side is placed in the second flow path, the clogging of the second flow path with mist can be suppressed. When the second flow path has an airflow generator for sending airflow to increase the flow rate of a fluid flowing in the second flow path, the clogging of the second flow path with mist can be suppressed. Another mist removal unit different from the mist removal unit on the first flow path may be provided on the second flow path as the clogging suppression mechanism.

The first flow path is unlikely to be clogged with mist because the mist removal unit removes a mist from the fluid, and the second flow path is unlikely to be clogged with mist because the clogging suppression mechanism is provided. Hence, the method for producing fluorine gas and the device for producing fluorine gas of the embodiments can suppress clogging of pipes and valves with mist when an electrolyte containing hydrogen fluoride and a metal fluoride is electrolyzed to produce fluorine gas. Even without the mist removal unit or the clogging suppression mechanism, simply switching the flow path in which a fluid flows, to another flow path (a first flow path or a second flow path) can achieve the effect of suppressing clogging of pipes and valves with mist, but the effect is highly achieved when the mist removal unit or the clogging suppression mechanism is provided.

The method for producing fluorine gas and the device for producing fluorine gas of the embodiments will next be described in further detail.

[Electrolytic Cell]

The electrolytic cell may be any cell that can electrolyze an electrolyte containing hydrogen fluoride and a metal fluoride to generate fluorine gas.

Typically, the inside of the electrolytic cell is sectioned by a partition member such as a partition wall into an anode chamber having an anode and a cathode chamber having a cathode, and this structure prevents the fluorine gas generated on the anode from mixing with the hydrogen gas generated on the cathode.

As the anode, for example, a carbonaceous electrode formed from a carbon material such as diamond, diamond-like carbon, amorphous carbon, graphite, glassy carbon, and amorphous carbon can be used. As the anode, a metal electrode formed from a metal such as nickel and Monel (trademark) can also be used in addition to the carbon material. As the cathode, for example, a metal electrode formed from a metal such as iron, copper, nickel, and Monel (trademark) can be used.

The electrolyte contains hydrogen fluoride and a metal fluoride. The metal fluoride may be any type and is preferably a fluoride of at least one metal selected from the group consisting of potassium, cesium, rubidium, and lithium. When containing cesium or rubidium, the electrolyte has a larger specific gravity and thus suppresses the amount of a mist generated during electrolysis.

As the electrolyte, for example, a mixed molten salt of hydrogen fluoride (HF) and potassium fluoride (KF) can be used. In the mixed molten salt of hydrogen fluoride and potassium fluoride, the molar ratio of hydrogen fluoride to potassium fluoride can be, for example, hydrogen fluoride: potassium fluoride=1.5 to 2.5:1. A typical electrolyte is KF·2HF where the ratio of hydrogen fluoride to potassium fluoride is 2:1, and the mixed molten salt has a melting point of about 72° C. The electrolyte has corrosivity, and thus a portion to come into contact with the electrolyte, such as the inner face of the electrolytic cell, is preferably formed from a metal such as iron, nickel, and Monel (trademark).

During electrolysis of the electrolyte, a direct current is applied to the anode and the cathode. Accordingly, a gas containing fluorine gas is generated on the anode, whereas a gas containing hydrogen gas is generated on the cathode. The hydrogen fluoride in the electrolyte has a vapor pressure, and thus gases generated on the anode and the cathode are accompanied with hydrogen fluoride. In the production of fluorine gas by electrolysis of an electrolyte, a gas generated by the electrolysis also contains a mist of the electrolyte. Accordingly, the gas phase in the electrolytic cell contains a gas generated by electrolysis, hydrogen fluoride, and a mist of the electrolyte. Hence, the substance sent from the inside to the outside of the electrolytic cell contains a gas generated by electrolysis, hydrogen fluoride, and a mist of the electrolyte and is called a "fluid" in the present invention.

As electrolysis proceeds, the hydrogen fluoride in the electrolyte is consumed, and thus a pipe for continuously or intermittently feeding and resupplying hydrogen fluoride into the electrolytic cell may be connected to the electrolytic cell. Hydrogen fluoride may be fed to either the cathode chamber or the anode chamber of the electrolytic cell.

A mist is generated during electrolysis of an electrolyte mainly due to the following reason. The temperature of an electrolyte during electrolysis is adjusted, for example, at 80 to 100° C. KF·2HF has a melting point of 71.7° C., and thus the electrolyte is in the liquid state when the temperature is adjusted as above. Bubbles of the gas generated on both the electrodes in the electrolytic cell rise in the electrolyte and burst on the surface of the electrolyte. On the bursting, the electrolyte is partially discharged into the gas phase.

The gas phase has a temperature lower than the melting point of the electrolyte, and thus the discharged electrolyte changes in phase into such a state as microscopic particles. The fine particles are supposedly a mixture of potassium fluoride and hydrogen fluoride, KF·nHF. The fine particles float on a separately generated gas and become a mist, forming a fluid generated in the electrolytic cell. Such a mist has tackiness and the like and thus is difficult to efficiently remove by conventional countermeasures such as installation of filters.

A carbonaceous electrode as the anode may be reacted with fluorine gas generated by electrolysis to generate impalpable particles of an organic compound as a mist in a small amount. Specifically, an electric current supply portion to the carbonaceous electrode has a contact resistance in many cases and may have a temperature higher than the temperature of the electrolyte due to Joule heat. Hence, the carbon included in the carbonaceous electrode may be reacted with fluorine gas to generate a soot-like organic compound, CFx, as a mist.

The electrolytic cell preferably has a structure in which bubbles generated on the anode or the cathode used in the electrolysis can vertically rise in the electrolyte to reach the surface of the electrolyte. In an electrolytic cell having a structure in which bubbles are unlikely to vertically rise but rise in a direction inclined relative to the vertical direction, a plurality of bubbles are likely to gather to form large bubbles. The resulting large bubbles reach the surface of the electrolyte and burst, and the amount of a mist is likely to increase. When an electrolytic cell has a structure in which bubbles can vertically rise in an electrolyte to reach the surface of the electrolyte, small bubbles reach the surface of the electrolyte and burst, and thus the amount of a mist is likely to decrease.

[Average Particle Size Measurement Unit]

The device for producing fluorine gas of the embodiment includes an average particle size measurement unit for measuring the average particle size of a mist contained in a fluid. The average particle size measurement unit may include a light scattering detector for measuring the average particle size by light scattering. The light scattering detector can measure the average particle size of a mist in a fluid flowing in a flow path while the device for producing fluorine gas is continuously operated and thus is preferred as the average particle size measurement unit.

An example light scattering detector will be described with reference to FIG. 1. The light scattering detector in FIG. 1 is a light scattering detector usable as the average particle size measurement unit in the device for producing fluorine gas of the embodiment (for example, the devices for producing fluorine gas in FIG. 2 and FIGS. 4 to 13 described later). In other words, the light scattering detector measures the average particle size of a mist contained in a fluid generated in the electrolytic cell when an electrolyte containing hydrogen fluoride and a metal fluoride is electrolyzed in the electrolytic cell of the device for producing fluorine gas to produce fluorine gas.

The light scattering detector may be connected to the device for producing fluorine gas, and the average particle size of a mist may be measured while a fluid is sent from the inside of the electrolytic cell to the light scattering detector. Alternatively, the light scattering detector may not be connected to the device for producing fluorine gas and may measure the average particle size of a mist while a fluid is sampled from the inside of the electrolytic cell and is introduced to the light scattering detector.

The light scattering detector in FIG. 1 includes a sample chamber 1 for receiving a fluid F, a light source 2 for applying light for light scattering measurement L to the fluid F in the sample chamber 1, a scattered light detection unit 3 for detecting scattered light S generated when the light for light scattering measurement L is scattered by a mist M in the fluid F, a transparent window 4A that is placed in the sample chamber 1 and is in contact with the fluid F and through which the light for light scattering measurement L passes, and a transparent window 4B that is placed in the sample chamber 1 and is in contact with the fluid F and through which the scattered light S passes. The transparent windows 4A, 4B are formed from at least one selected from the group consisting of diamond, calcium fluoride ($CaF_2$), potassium fluoride (KF), silver fluoride (AgF), barium fluoride ($BaF_2$), and potassium bromide (KBr).

The light for light scattering measurement L (for example, a laser beam) emitted from the light source 2 passes through a converging lens 6 and the transparent window 4A of the sample chamber 1, enters the sample chamber 1, and is applied to the fluid F received in the sample chamber 1. At the application, when the fluid F contains a light reflective substance such as a mist M, the light for light scattering measurement L is reflected and scattered. The scattered light S generated when the light for light scattering measurement L is scattered by the mist M partially passes through the transparent window 4B of the sample chamber 1, is retrieved from the sample chamber 1 to the outside, and enters the scattered light detection unit 3 through a condensing lens 7 and a throttle 8. From the information of the scattered light S, the average particle size of the mist M can be determined.

The average particle size determined by the detector is a number average particle size. As the scattered light detection unit 3, for example, an aerosol spectrometer, Welas (registered trademark) digital 2000 manufactured by PALAS can be used.

The transparent windows 4A, 4B are in contact with the fluid F. The fluid F contains highly reactive fluorine gas, and thus the transparent windows 4A, 4B are required to be formed from a material that is unlikely to be corroded by fluorine gas. The material for forming the transparent windows 4A, 4B is, for example, at least one selected from the group consisting of diamond, calcium fluoride, potassium fluoride, silver fluoride, barium fluoride, and potassium bromide. When the transparent windows 4A, 4B are formed from such a material as above, the deterioration by contact with the fluid F can be suppressed.

A glass such as quartz having a surface coated with a film formed of such a material as above can also be used as the transparent windows 4A, 4B. The portion to come into contact with the fluid F is coated with a film formed of such a material as above, and thus the deterioration by contact with the fluid F can be suppressed while the cost is reduced. Each transparent window 4A, 4B may be a laminate in which a face to come into contact with the fluid F is formed of such a material as above, and the other portions are formed of a common glass such as quartz.

The members of the light scattering detector except the transparent windows 4A, 4B may be made from any material having corrosion resistance against fluorine gas, and, for example, a metal material such as Monel (trademark) that is a copper-nickel alloy, hastelloy (trademark), and stainless steel is preferably used.

[Average Particle Size of Mist]

The inventors of the present invention measured the average particle size of a mist generated during production of fluorine gas by electrolysis of an electrolyte, by using the light scattering detector. An example of the result will be described. After the anode of a device for producing fluorine gas is exchanged for a new anode or an electrolytic cell is filled with a fresh electrolyte, electrolysis is started, and the average particle size of a mist in a fluid generated on the anode was measured for a certain period of time from just after the start of electrolysis. As a result, the mist had an average particle size of 0.5 to 2.0 μm. After a sufficient time period of continuous electrolysis, the electrolysis is becoming stable. During the stable electrolysis, the mist in the fluid had an average particle size of about 0.2 μm.

As described above, a mist having a relatively large particle size is generated from just after the start of electrolysis to the stable electrolysis. If the fluid containing a mist having a large size just after the start of electrolysis flows in pipes and valves, the mist is likely to adsorb onto the inner face of the pipes and valves, causing clogging of the pipes and valves.

In contrast, during stable electrolysis, the generated mist has a relatively small particle size. Such a small mist is unlikely to settle or deposit in a fluid and thus can flow stably in pipes and valves. Hence, during stable electrolysis, a fluid consisting of a mist and a gas generated on an electrode has a relatively low possibility of causing clogging of pipes and valves. The time from the start of electrolysis to the stable electrolysis is typically 25 hours or more and 200 hours or less. From the start of electrolysis to the stable electrolysis, an electric energy of about 40 kAh or more is required to be applied for 1,000 L of an electrolyte.

Based on such knowledge, the inventors of the present invention have invented the method for producing fluorine gas and the device for producing fluorine gas, having a structure in which a flow path in which a fluid flows can be switched in accordance with the average particle size of a mist measured by the light scattering detector. The device for producing fluorine gas of the embodiment has a first flow path and a second flow path, and a flow path switching unit (for example, a switching valve) may be used to select, from the two flow paths, a flow path used to convey a fluid.

Alternatively, the device for producing fluorine gas of the embodiment may have two flow paths and a transfer and replacement mechanism for transferring and replacing an electrolytic cell. From the two flow paths, a flow path used to convey a fluid may be selected, and an electrolytic cell may be transferred near the flow path and be connected to the flow path. This can switch the flow path.

The device has the first flow path and the second flow path as described above. Hence, even while one flow path is blocked and cleaned, the other flow path can be opened, and the device for producing fluorine gas can be continuously operated.

From studies by the inventors of the present invention, a mist having a relatively large average particle size is generated from the start of electrolysis to the stable electrolysis, and thus a fluid can be sent to the second flow path having a clogging suppression mechanism. When the electrolysis becomes stable as time passes, a mist having a relatively small average particle size is generated, and thus the flow path can be switched such that the fluid is sent to the first flow path having a mist removal unit.

Such switching the flow path is performed in accordance with the average particle size of a mist measured by the light scattering detector, and the flow path is switched on the basis of a predetermined reference value. The appropriate reference value of a mist generated on the anode is 0.1 μm or more and 1.0 μm or less, preferably 0.2 μm or more and 0.8 μm or less, and more preferably 0.4 μm. When the average particle size of a mist measured by the light scattering detector is more than the reference value, the fluid can be sent to the second flow path, and when the average particle size is not more than the reference value, the fluid can be sent to the first flow path.

Also for a fluid (mainly containing hydrogen gas) generated on the cathode, the average particle size of the contained mist may be measured. The fluid generated on the cathode, for example, contains 20 to 50 μg of fine particles (calculated assuming that a mist has a specific gravity of 1.0 g/mL) per unit volume (1 liter), and the fine particles have an average particle size of about 0.1 μm with a distribution of ±0.05 μm.

In the fluid generated on the cathode, a large difference in particle size distribution of the generated fine particles was not observed even when the water concentration contained in an electrolyte varied. The mist contained in the fluid generated on the cathode has a smaller average particle size than the mist contained in the fluid generated on the anode and thus is unlikely to cause clogging of pipes and valves as compared with the mist contained in the fluid generated on the anode. Hence, the mist contained in the fluid generated on the cathode can be removed from the fluid by using an appropriate removal method.

An example of the device for producing fluorine gas of the embodiment will be described in detail with reference to FIG. 2. The device for producing fluorine gas in FIG. 2 is an example including two electrolytic cells, but a single electrolytic cell may be included, or three or more, for example, 10 to 15 electrolytic cells may be included.

Figure 2:
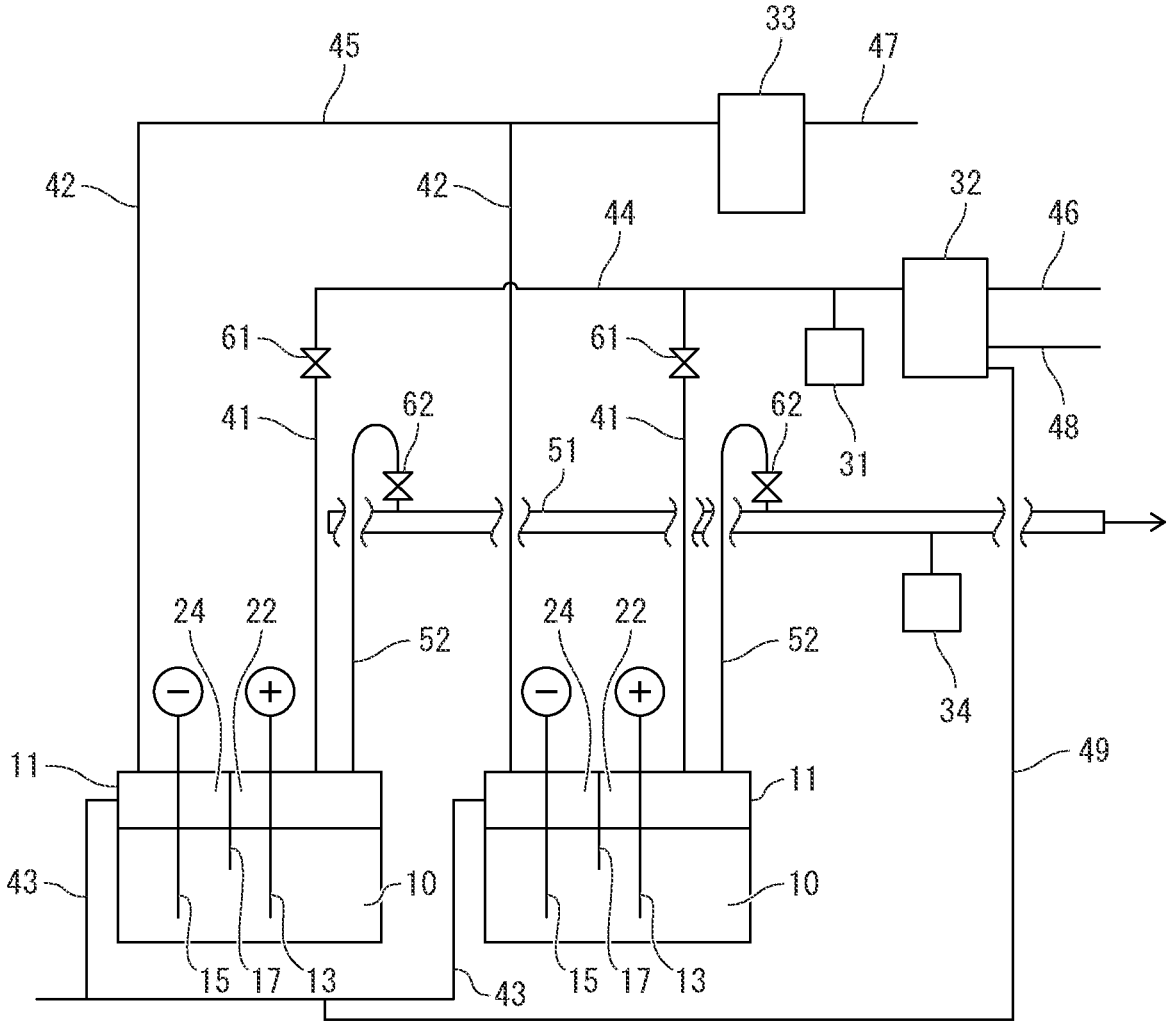
FIG. 2 is a schematic view illustrating an example device for producing fluorine gas pertaining to an embodiment of the present invention.

The device for producing fluorine gas illustrated in FIG. 2 includes electrolytic cells 11, 11 in which an electrolyte 10 is stored and electrolysis is performed, an anode 13 placed in each electrolytic cell 11 and immersed in the electrolyte 10, and a cathode 15 placed in each electrolytic cell 11, immersed in the electrolyte 10, and facing the anode 13.

The inside of each electrolytic cell 11 is sectioned into an anode chamber 22 and a cathode chamber 24 by a partition wall 17 extending from a ceiling face in the electrolytic cell 11 downward in the vertical direction and having a lower end immersed in the electrolyte 10. In the anode chamber 22, the anode 13 is placed, and in the cathode chamber 24, the cathode 15 is placed. The space above the surface of the electrolyte 10 is separated by the partition wall 17 into a space in the anode chamber 22 and a space in the cathode chamber 24, and a portion of the electrolyte 10 above the lower end of the partition wall 17 is separated by the partition wall 17, but a portion of the electrolyte 10 below the lower end of the partition wall 17 is not directly separated by the partition wall 17 but continues.

The device for producing fluorine gas illustrated in FIG. 2 includes a first average particle size measurement unit 31 that measures the average particle size of a mist contained in a fluid generated in each electrolytic cell 11 during electrolysis of the electrolyte 10, a first mist removal unit 32 that removes a mist from a fluid, a fluorine gas selection unit (not illustrated) that selectively collects fluorine gas from a fluid, and a flow path configured to send a fluid from the inside of each electrolytic cell 11 to the fluorine gas selection unit.

The flow path includes a first flow path that sends a fluid from the inside of each electrolytic cell 11 through the first mist removal unit 32 to the fluorine gas selection unit and a second flow path that sends a fluid from the inside of each electrolytic cell 11 to the fluorine gas selection unit but not through the first mist removal unit 32. The flow path also includes a flow path switching unit configured to switch the flow path in which a fluid flows, to the first flow path or the second flow path in accordance with the average particle size of a mist measured by the first average particle size measurement unit 31. In other words, at an intermediate point of the flow path extending from the electrolytic cell 11, the flow path switching unit is provided, and the flow path switching unit can alter the flow path in which a fluid flows.

The flow path switching unit sends a fluid from the inside of each electrolytic cell 11 to the first flow path when the average particle size of a mist measured by the first average particle size measurement unit 31 is not more than a predetermined reference value or sends a fluid from the inside of each electrolytic cell 11 to the second flow path when the average particle size is more than the predetermined reference value. The second flow path has a clogging suppression mechanism that suppresses the clogging of the second flow path with mist.

In other words, when the average particle size of a mist is not more than a reference value, the electrolytic cell 11 is connected to a fluorine gas selection unit, and the fluid is sent to the first flow path with the first mist removal unit 32. When the average particle size of a mist is more than the reference value, the electrolytic cell 11 is connected to a fluorine gas selection unit, and the fluid is sent to the second flow path with the clogging suppression mechanism.

As the first average particle size measurement unit 31, for example, the above light scattering detector illustrated in FIG. 1 can be used.

As the first mist removal unit 32, for example, a mist remover capable of removing a mist having an average particle size of 0.4 μm or less from a fluid is used. The type of mist remover, or the system of removing a mist is not specifically limited, but a mist has a small average particle size, and thus, for example, an electric dust collector, a venturi scrubber, or a filter can be used as the mist remover.

Figure 3:
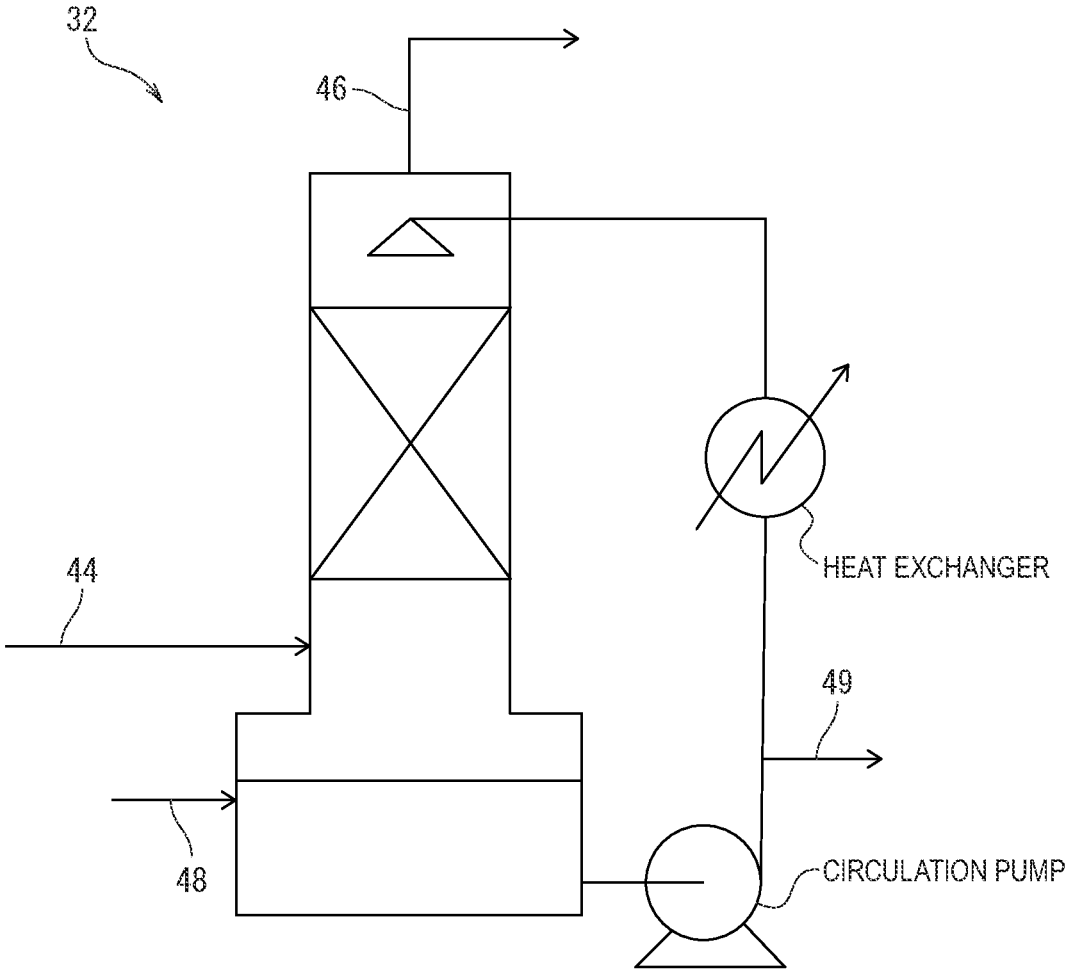
FIG. 3 is a view schematically illustrating an example mist remover used as a mist removal unit in the device for producing fluorine gas in FIG. 2.

Of the above mist removers, the mist remover illustrated in FIG. 3 is preferably used. The mist remover illustrated in FIG. 3 is a scrubber type mist remover using a liquid hydrogen fluoride as a circulating liquid. The mist remover illustrated in FIG. 3 can efficiently remove a mist having an average particle size of 0.4 μm or less from a fluid. The mist remover uses a liquid hydrogen fluoride as a circulating liquid. The circulating liquid is preferably cooled in order to reduce the concentration of hydrogen fluoride in a fluorine gas, and thus the concentration of hydrogen fluoride in a fluorine gas can be controlled by adjusting the cooling temperature.

The device for producing fluorine gas illustrated in FIG. 2 will be described in further detail. A first pipe 41 that sends a fluid generated in the anode chamber 22 in each electrolytic cell 11 (hereinafter also called "anode gas") to the outside connects the electrolytic cell 11 to a fourth pipe 44, and the anode gases sent from the two electrolytic cells 11, 11 are sent through the first pipes 41 to the fourth pipe 44 and are mixed. The main component of the anode gas is fluorine gas, and accessory components are mist, hydrogen fluoride, carbon tetrafluoride, oxygen gas, and water.

The fourth pipe 44 is connected to the first mist removal unit 32, and the anode gas is sent through the fourth pipe 44 to the first mist removal unit 32. The first mist removal unit 32 removes mist and hydrogen fluoride in the anode gas from the anode gas. The anode gas from which the mist and hydrogen fluoride have been removed is sent from the first mist removal unit 32 through a sixth pipe 46 connected to the first mist removal unit 32 to a fluorine gas selection unit (not illustrated). The fluorine gas selection unit then selectively collects fluorine gas from the anode gas.

The first mist removal unit 32 is connected to an eighth pipe 48, and a liquid hydrogen fluoride as the circulating liquid is supplied through the eighth pipe 48 to the first mist removal unit 32. The first mist removal unit 32 is further connected to a ninth pipe 49. The ninth pipe 49 is connected through third pipes 43 to the electrolytic cells 11, 11, and a circulating liquid (liquid hydrogen fluoride) containing a mist and having used to remove a mist in the first mist removal unit 32 is returned from the first mist removal unit 32 to the electrolytic cells 11, 11.

The cathode chamber 24 in each electrolytic cell 11 is substantially the same as the anode chamber 22. In other words, a second pipe 42 that sends a fluid generated in the cathode chamber 24 in each electrolytic cell 11 (hereinafter also called "cathode gas") to the outside connects the electrolytic cell 11 to a fifth pipe 45, and the cathode gases sent from the two electrolytic cells 11, 11 are sent through the second pipes 42 to the fifth pipe 45 and are mixed. The main component of the cathode gas is hydrogen gas, and accessory components are mist, hydrogen fluoride, and water.

The cathode gas contains a fine mist and 5 to 10% by volume of hydrogen fluoride, and thus it is unfavorable to directly discharge the cathode gas to the atmosphere. To address this, the fifth pipe 45 is connected to a second mist removal unit 33, and the cathode gas is sent through the fifth pipe 45 to the second mist removal unit 33. The second mist removal unit 33 removes mist and hydrogen fluoride in the cathode gas from the cathode gas. The cathode gas from which the mist and hydrogen fluoride have been removed is discharged from the second mist removal unit 33 through a seventh pipe 47 connected to the second mist removal unit 33 to the atmosphere. The type of second mist removal unit 33, or the system of removing a mist is not specifically limited, and a scrubber type mist remover using an aqueous alkali solution as the circulating liquid can be used.

The pipe diameters and the installation directions (i.e., a pipe extending direction, for example, the vertical direction, the horizontal direction) of the first pipe 41, the second pipe 42, the fourth pipe 44, and the fifth pipe 45 are not specifically limited. The first pipe 41 and the second pipe 42 are preferably installed so as to extend from the electrolytic cell 11 in the vertical direction and preferably have a pipe diameter such that fluids flowing in the first pipe 41 and the second pipe 42 have a flow rate of 30 cm/sec or less in a normal state. In such conditions, even when a mist contained in a fluid falls under its own weight, the mist settles in the electrolytic cell 11, and thus the clogging in the first pipe 41 and the second pipe 42 with fine particles is unlikely to be caused.

The fourth pipe 44 and the fifth pipe 45 are preferably installed so as to extend in the horizontal direction and preferably have a pipe diameter such that fluids flowing in the fourth pipe 44 and the fifth pipe 45 have a flow rate about 1 to 10 times more than that in the first pipe 41 and the second pipe 42.

A second bypass pipe 52 for sending the anode gas to the outside of the electrolytic cell 11 is further provided separately from the first pipe 41. In other words, the second bypass pipe 52 connects each electrolytic cell 11 to a first bypass pipe 51, and the anode gases sent from the two electrolytic cells 11, 11 are sent through the second bypass pipes 52 to the first bypass pipe 51 and are mixed. Through the first bypass pipe 51, the anode gas is sent to a fluorine gas selection unit (not illustrated). The fluorine gas selection unit selectively collects fluorine gas from the anode gas. The fluorine gas selection unit connected to the first bypass pipe 51 may be the same as or different from the fluorine gas selection unit connected to the sixth pipe 46.

The pipe diameter and the installation direction of the second bypass pipe 52 are not specifically limited, and the second bypass pipe 52 is preferably installed so as to extend from the electrolytic cell 11 in the vertical direction and preferably has a pipe diameter such that a fluid flowing in the second bypass pipe 52 has a flow rate of 30 cm/sec or less in a normal state.

The first bypass pipe 51 is installed so as to extend in the horizontal direction. The first bypass pipe 51 has a larger pipe diameter than the fourth pipe 44, and the pipe diameter of the first bypass pipe 51 is such a size as to be unlikely to cause clogging of the first bypass pipe 51 with depositing fine particles. The first bypass pipe 51 has a larger pipe diameter than the fourth pipe 44, and this functions as the clogging suppression mechanism.

The pipe diameter of the first bypass pipe 51 is preferably more than 1.0 time and not more than 3.2 times that of the fourth pipe 44 and more preferably not less than 1.05 times and not more than 1.5 times. In other words, the first bypass pipe 51 preferably has a flow path cross-sectional area not more than 10 times that of the fourth pipe 44.

As apparent from the above description, the first pipes 41 and the fourth pipe 44 constitute the above first flow path, and the first bypass pipe 51 and the second bypass pipes 52 constitute the above second flow path. The first bypass pipe 51 included in the second flow path has the clogging suppression mechanism.

Next, the flow path switching unit will be described. Each first pipe 41 has a first pipe valve 61. By switching the first pipe valve 61 to an open state or a closed state, whether the anode gas is sent from the electrolytic cell 11 to the first mist removal unit 32 can be controlled. Each second bypass pipe 52 has a bypass valve 62. By switching the bypass valve 62 to an open state or a closed state, whether the anode gas is sent from the electrolytic cell 11 to the first bypass pipe 51 can be controlled.

Between the electrolytic cells 11 and the first mist removal unit 32, specifically, at an intermediate point of the fourth pipe 44 and at the downstream side of the junctions to the first pipes 41, a first average particle size measurement unit 31 is provided. The first average particle size measurement unit 31 measures the average particle size of a mist contained in the anode gas flowing in the fourth pipe 44. By analyzing fluorine gas and nitrogen gas contained in the anode gas after measuring the average particle size of a mist, the current efficiency in the production of fluorine gas can be determined. At an intermediate point of the first bypass pipe 51 and at the downstream side of the junctions to the second bypass pipes 52, a second average particle size measurement unit 34 is also provided, and the second average particle size measurement unit 34 measures the average particle size of a mist contained in the anode gas flowing in the first bypass pipe 51.

The average particle size of a mist is measured by the first average particle size measurement unit 31 (the average particle size of a mist can be simultaneously measured by the second average particle size measurement unit 34). When the measurement result is more than a predetermined reference value, the bypass valve 62 is switched to an open state to send the anode gas from the electrolytic cell 11 to the first bypass pipe 51, and the first pipe valve 61 is switched to a closed state not to send the anode gas to the fourth pipe 44 and the first mist removal unit 32. In other words, the anode gas is sent to the second flow path.

In contrast, when the measurement result is not more than a predetermined reference value, the first pipe valve 61 is switched to an open state to send the anode gas to the fourth pipe 44 and the first mist removal unit 32, and the bypass valve 62 is switched to a closed state not to send the anode gas from the electrolytic cell 11 to the first bypass pipe 51. In other words, the anode gas is sent to the first flow path.

As apparent from the above description, the first pipe valve 61 and the bypass valve 62 constitute the above flow path switching unit.

As described above, by operating the device for producing fluorine gas while the flow path is switched in accordance with the average particle size of a mist, continuous operation can be smoothly performed while clogging of pipes and valves with mist is suppressed. By using the device for producing fluorine gas illustrated in FIG. 2, fluorine gas can be economically produced.

For example, as the mist removal unit, a plurality of pipes with filters may be prepared, and electrolysis may be performed while the pipes are appropriately switched to exchange the filters.

A time period when frequent exchange of filters is needed and a time period when frequent exchange of filters is not needed can be determined on the basis of measurement by the light scattering detector applied as the average particle size measurement unit. By appropriately controlling the switching frequency of pipes in which a fluid flows on the basis of the above determination, the device for producing fluorine gas can be efficiently, continuously operated.

Alternative embodiments of the device for producing fluorine gas illustrated in FIG. 2 will next be described.

First Alternative Embodiment

Figure 4:
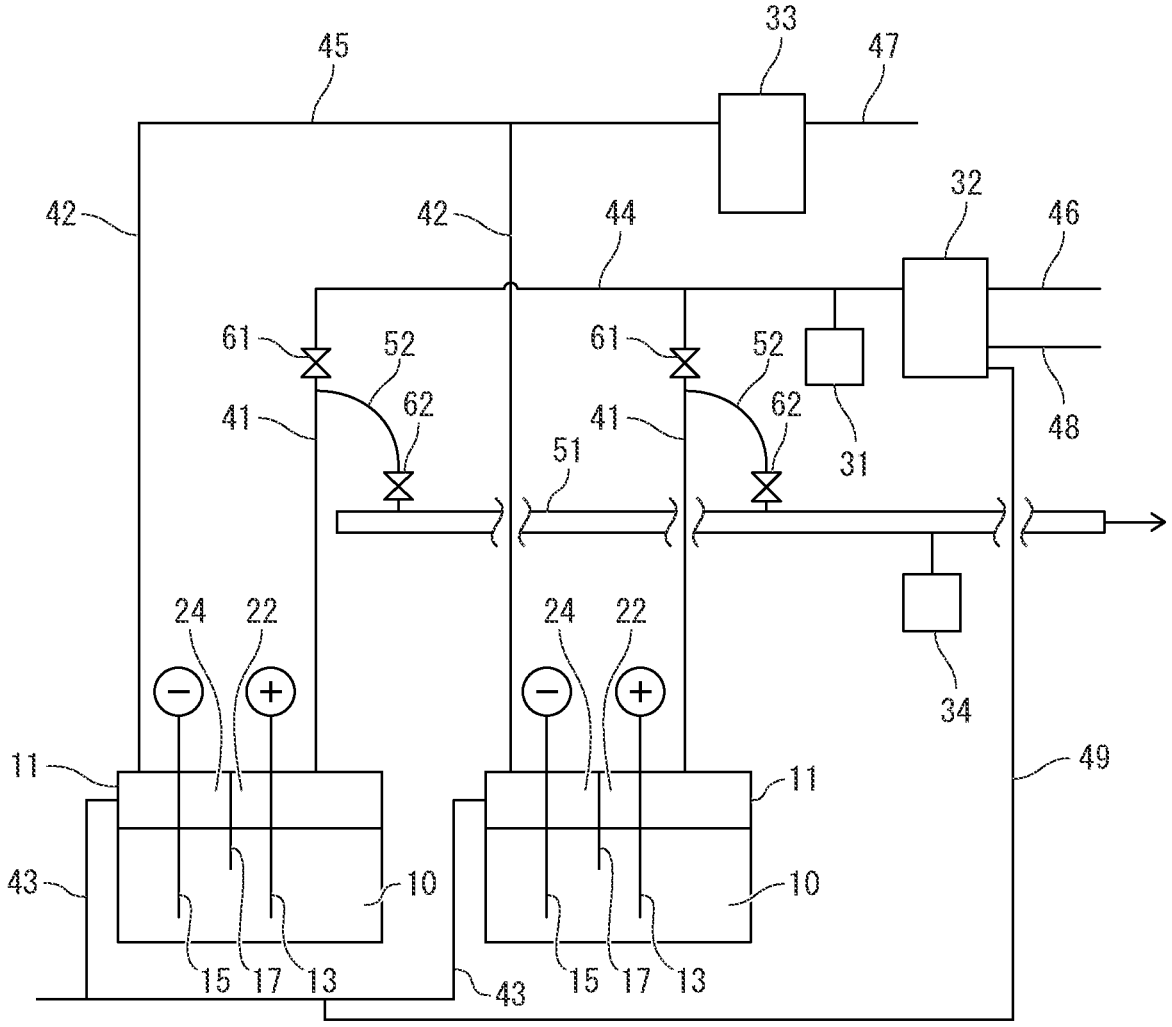
FIG. 4 is a schematic view illustrating a first alternative embodiment of the device for producing fluorine gas in FIG. 2.

A first alternative embodiment will be described with reference to FIG. 4. In the device for producing fluorine gas illustrated in FIG. 2, the second bypass pipes 52 connect the electrolytic cells 11 to the first bypass pipe 51. In contrast, in a device for producing fluorine gas in the first alternative embodiment illustrated in FIG. 4, second bypass pipes 52 connect first pipes 41 to a first bypass pipe 51. The device for producing fluorine gas in the first alternative embodiment has substantially the same constitution as the device for producing fluorine gas in FIG. 2 except the above structure, and thus similar structures are not described.

Second Alternative Embodiment

Figure 5:
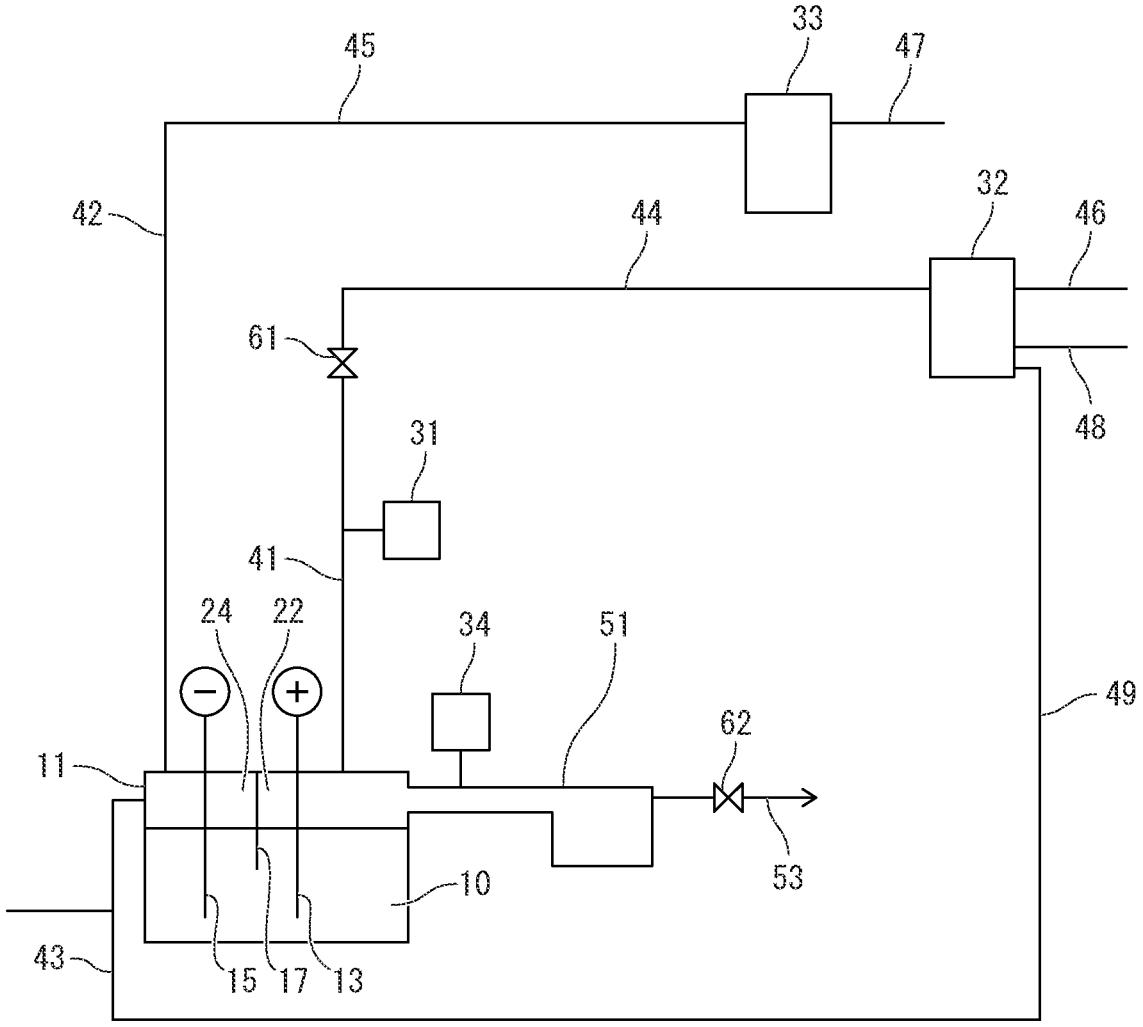
FIG. 5 is a schematic view illustrating a second alternative embodiment of the device for producing fluorine gas in FIG. 2.

A second alternative embodiment will be described with reference to FIG. 5. A device for producing fluorine gas in the second alternative embodiment illustrated in FIG. 5 includes a single electrolytic cell 11. A first average particle size measurement unit 31 is not provided on a fourth pipe 44 but on a first pipe 41 and is provided at the upstream side of a first pipe valve 61. The device includes no second bypass pipe 52, and a first bypass pipe 51 is directly connected to an electrolytic cell 11 but not through a second bypass pipe 52.

The first bypass pipe 51 has a larger diameter than the fourth pipe 44 and thus functions as the clogging suppression mechanism. A mist pool space is further provided, for example, at the downstream end of the first bypass pipe 51, and this can further improve the clogging suppression effect. Examples of the mist pool space include a space formed from the downstream end portion of the first bypass pipe 51 and having a larger pipe diameter than the center portion in the installation direction (for example, a pipe diameter not less than 4 times that at the center portion in the installation direction) and a space formed from the downstream end portion of the first bypass pipe 51 and having a container shape. The mist pool space can suppress clogging of the first bypass pipe 51. This is aimed at a clogging suppression effect by a large flow path cross-sectional area and a clogging suppression effect using mist free fall by a reduction in linear velocity of a flowing gas.

In addition, a bypass valve 62 is provided on a third bypass pipe 53 that connects the first bypass pipe 51 to a fluorine gas selection unit (not illustrated). The device for producing fluorine gas in the second alternative embodiment has substantially the same constitution as the device for producing fluorine gas in FIG. 2 except the above structure, and thus similar structures are not described.

Third Alternative Embodiment

Figure 6:
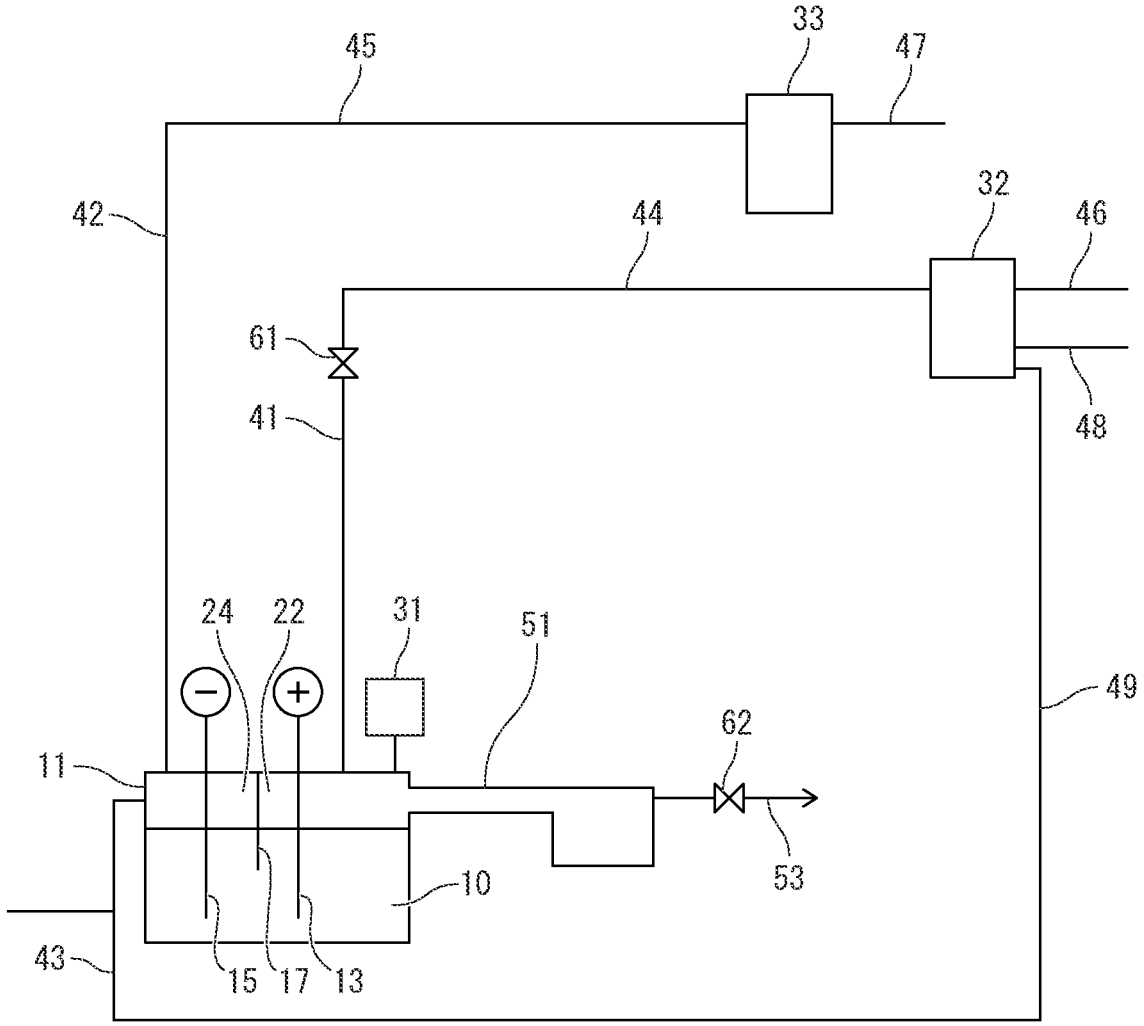
FIG. 6 is a schematic view illustrating a third alternative embodiment of the device for producing fluorine gas in FIG. 2.

A third alternative embodiment will be described with reference to FIG. 6. In a device for producing fluorine gas in the third alternative embodiment, a first average particle size measurement unit 31 is provided on an electrolytic cell 11, and the average particle size of a mist is measured by introducing the anode gas in the electrolytic cell 11 directly into the first average particle size measurement unit 31. The device for producing fluorine gas in the third alternative embodiment has no second average particle size measurement unit 34. The device for producing fluorine gas in the third alternative embodiment has substantially the same constitution as the device for producing fluorine gas in the second alternative embodiment except the above structure, and thus similar structures are not described.

Fourth Alternative Embodiment

Figure 7:
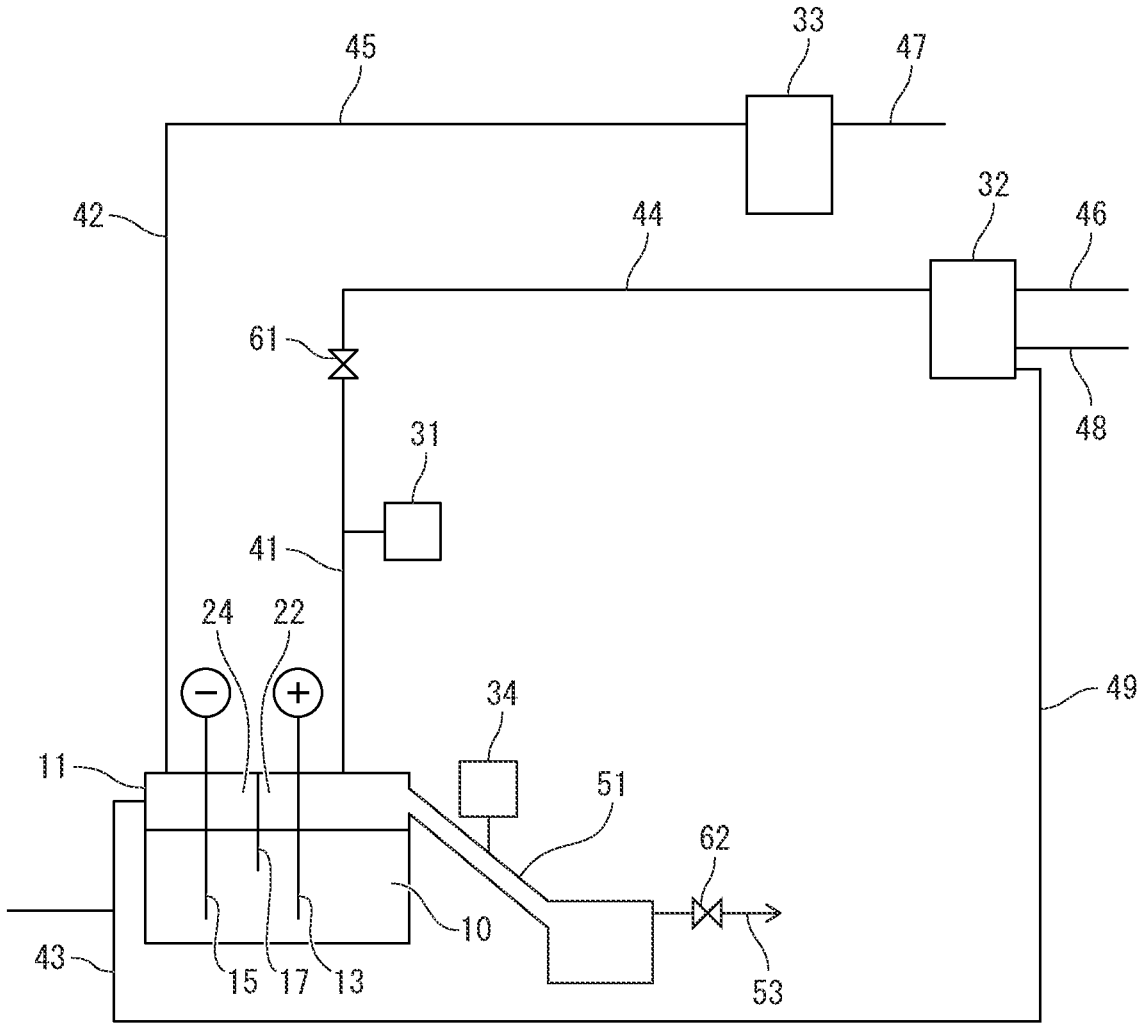
FIG. 7 is a schematic view illustrating a fourth alternative embodiment of the device for producing fluorine gas in FIG. 2.

A fourth alternative embodiment will be described with reference to FIG. 7. A device for producing fluorine gas in the fourth alternative embodiment differs from that in the second alternative embodiment illustrated in FIG. 5 in the clogging suppression mechanism. In the device for producing fluorine gas in the second alternative embodiment, the first bypass pipe 51 is provided so as to extend in the horizontal direction. In the device for producing fluorine gas in the fourth alternative embodiment, a first bypass pipe 51 is inclined relative to the horizontal direction and extends downward from the upstream side to the downstream side. This inclination prevents fine particles from depositing in the first bypass pipe 51. As the inclination is larger, the effect of suppressing fine particle deposition is larger.

The inclination angle of the first bypass pipe 51 is preferably 30 degrees or more and more preferably 40 degrees or more and 60 degrees or less where the depression angle from the horizontal plane is less than 90 degrees. When the first bypass pipe 51 is about to be clogged, hammering the inclined first bypass pipe 51 facilitates moving the deposit in the first bypass pipe 51, and thus clogging can be prevented.

The device for producing fluorine gas in the fourth alternative embodiment has substantially the same constitution as the device for producing fluorine gas in the second alternative embodiment except the above structure, and thus similar structures are not described.

Fifth Alternative Embodiment

Figure 8:
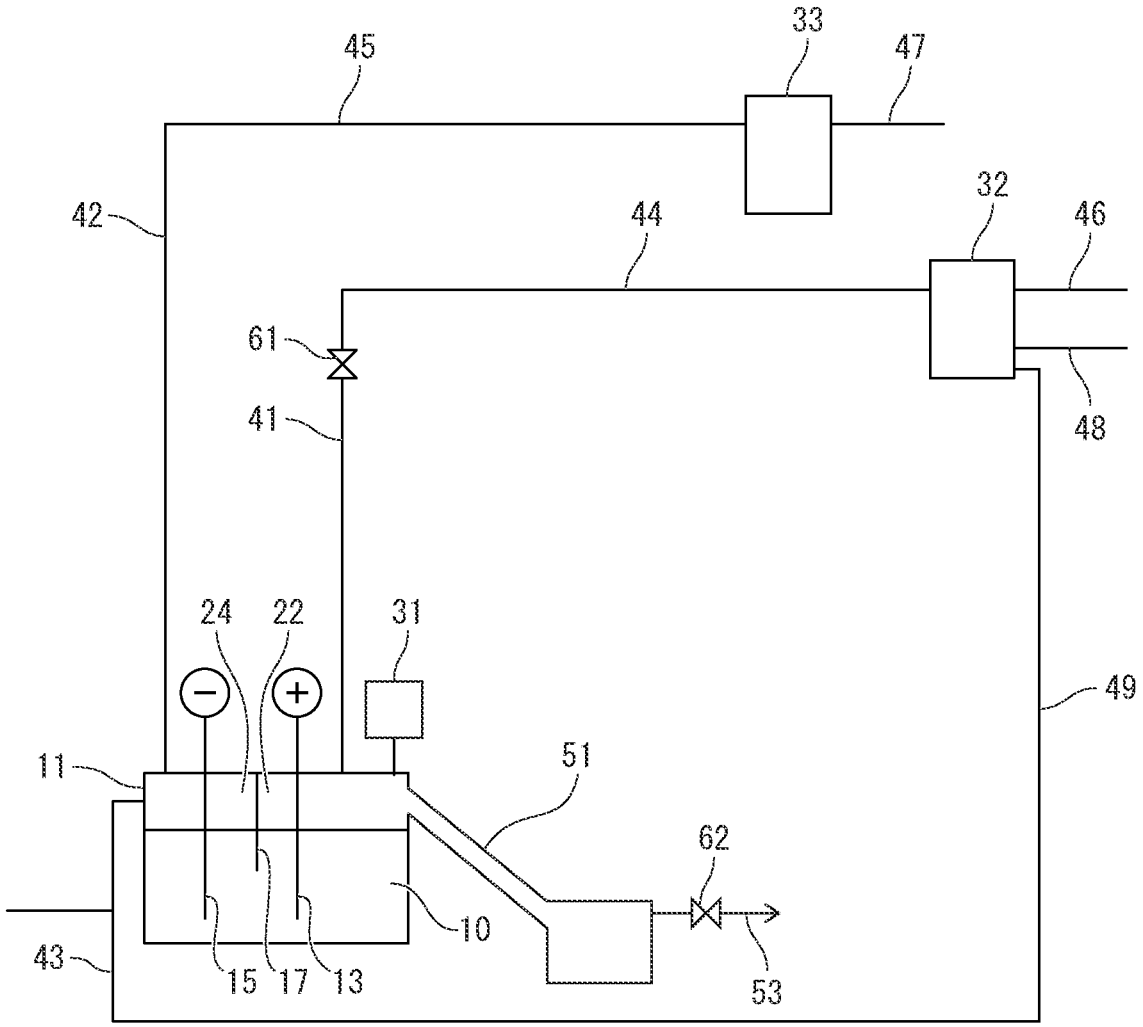
FIG. 8 is a schematic view illustrating a fifth alternative embodiment of the device for producing fluorine gas in FIG. 2.

A fifth alternative embodiment will be described with reference to FIG. 8. A device for producing fluorine gas in the fifth alternative embodiment differs from that in the third alternative embodiment illustrated in FIG. 6 in the clogging suppression mechanism. In the device for producing fluorine gas in the third alternative embodiment, the first bypass pipe 51 is provided so as to extend in the horizontal direction. In the device for producing fluorine gas in the fifth alternative embodiment, a first bypass pipe 51 is inclined relative to the horizontal direction and extends downward from the upstream side to the downstream side. This inclination prevents fine particles from depositing in the first bypass pipe 51. The inclination angle of the first bypass pipe 51 is preferably substantially the same as in the fourth alternative embodiment. The device for producing fluorine gas in the fifth alternative embodiment has substantially the same constitution as the device for producing fluorine gas in the third alternative embodiment except the above structure, and thus similar structures are not described.

Sixth Alternative Embodiment

Figure 9:
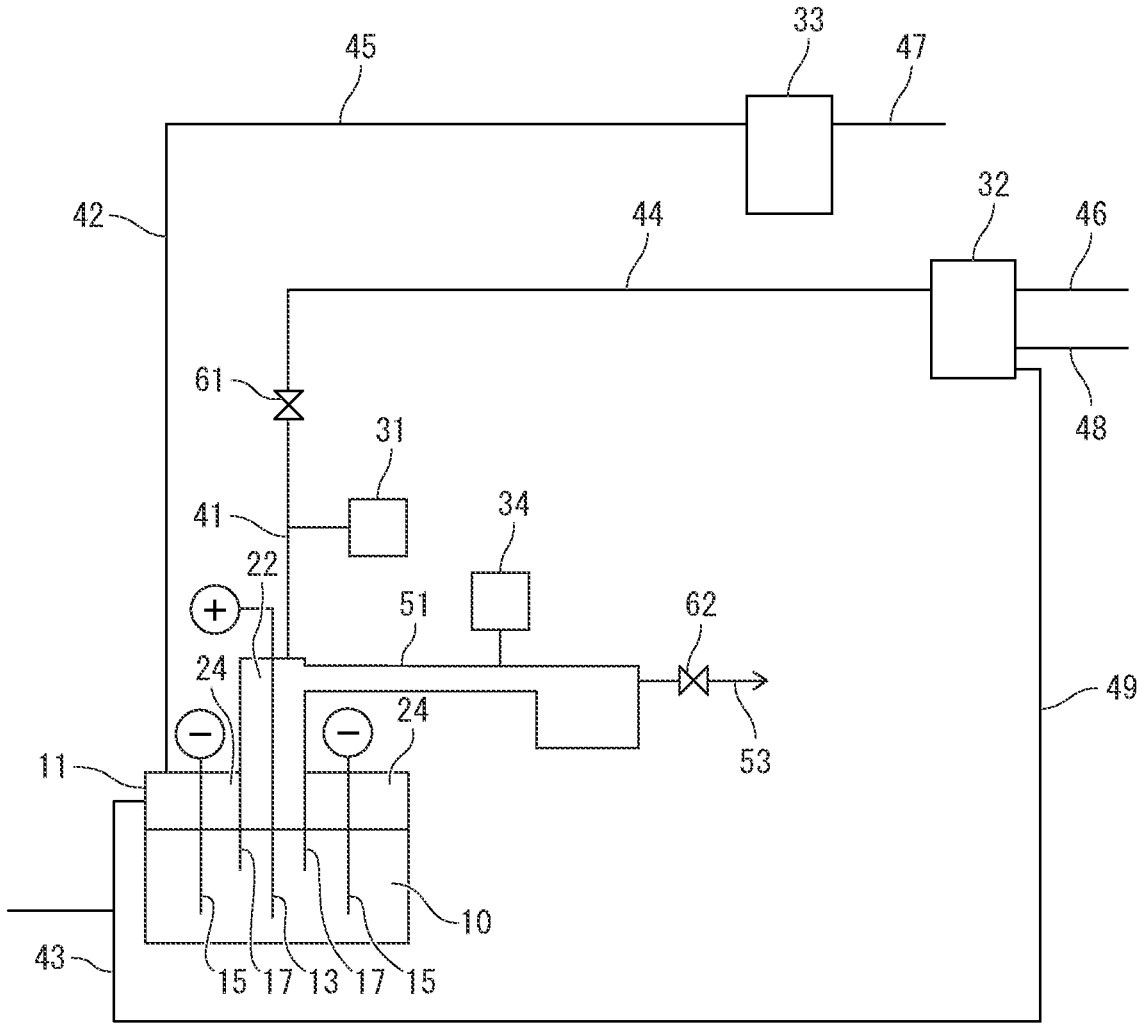
FIG. 9 is a schematic view illustrating a sixth alternative embodiment of the device for producing fluorine gas in FIG. 2.

A sixth alternative embodiment will be described with reference to FIG. 9. A device for producing fluorine gas in the sixth alternative embodiment differs from that in the second alternative embodiment illustrated in FIG. 5 in the structure of an electrolytic cell 11. The electrolytic cell 11 has one anode 13 and two cathodes 15, 15 and is sectioned into one anode chamber 22 and one cathode chamber 24 by a cylindrical partition wall 17 surrounding the one anode 13. The anode chamber 22 is formed to extend above the top face of the electrolytic cell 11, and a first bypass pipe 51 is connected to the top section of the anode chamber 22 of the electrolytic cell 11. The device for producing fluorine gas in the sixth alternative embodiment has substantially the same constitution as the device for producing fluorine gas in the second alternative embodiment except the above structure, and thus similar structures are not described.

Seventh Alternative Embodiment

Figure 10:
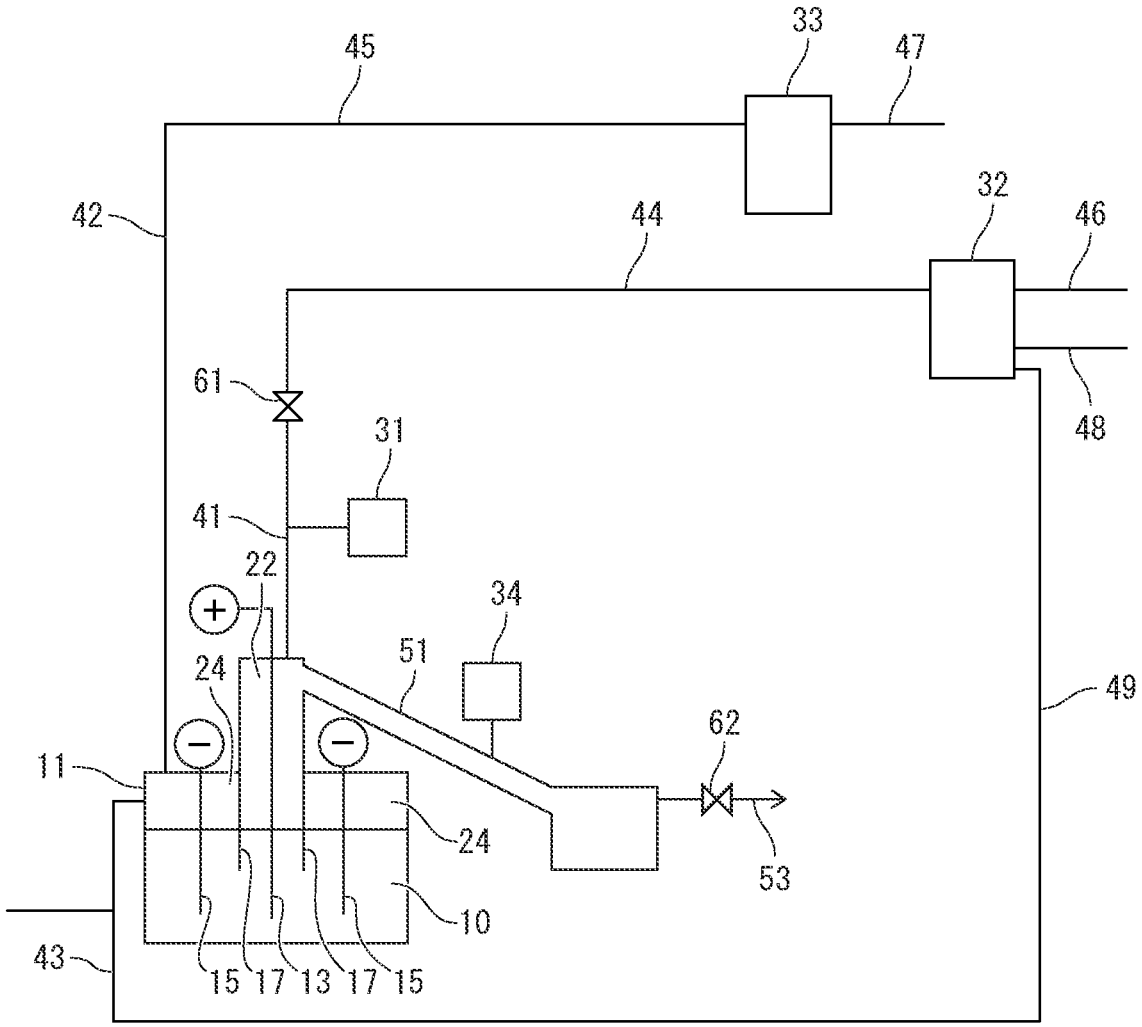
FIG. 10 is a schematic view illustrating a seventh alternative embodiment of the device for producing fluorine gas in FIG. 2.

A seventh alternative embodiment will be described with reference to FIG. 10. A device for producing fluorine gas in the seventh alternative embodiment differs from that in the sixth alternative embodiment illustrated in FIG. 9 in the structure of a first bypass pipe 51. In other words, in the device for producing fluorine gas in the seventh alternative embodiment, a first bypass pipe 51 is inclined relative to the horizontal direction and extends downward from the upstream side to the downstream side as with the fourth alternative embodiment and the fifth alternative embodiment. The inclination angle of the first bypass pipe 51 is preferably substantially the same as in the fourth alternative embodiment. The device for producing fluorine gas in the seventh alternative embodiment has substantially the same constitution as the device for producing fluorine gas in the sixth alternative embodiment except the above structure, and thus similar structures are not described.

Eighth Alternative Embodiment

Figure 11:
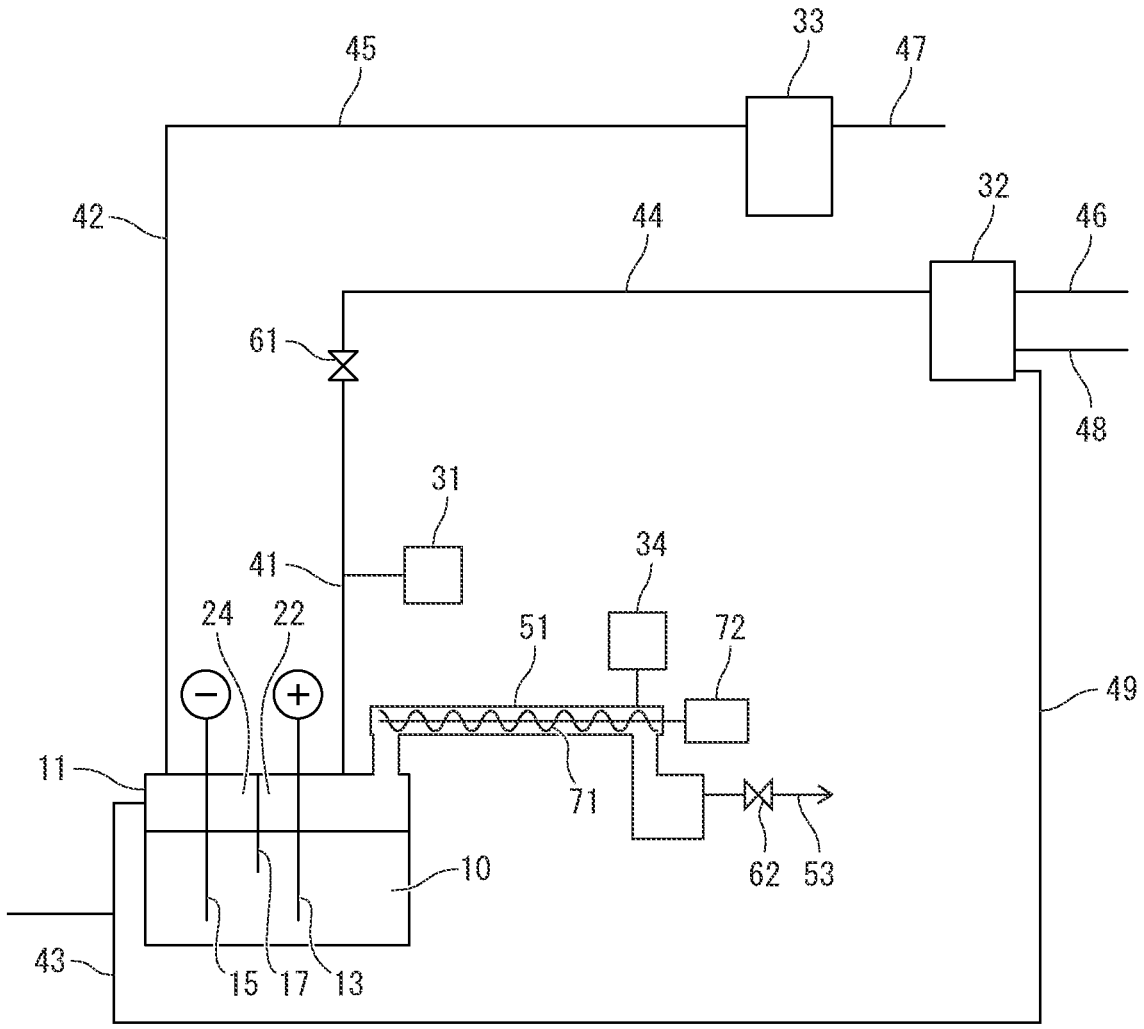
FIG. 11 is a schematic view illustrating an eighth alternative embodiment of the device for producing fluorine gas in FIG. 2.

An eighth alternative embodiment will be described with reference to FIG. 11. A device for producing fluorine gas in the eighth alternative embodiment differs from that in the second alternative embodiment illustrated in FIG. 5 in the clogging suppression mechanism. In the device for producing fluorine gas in the eighth alternative embodiment, a rotary screw 71 constituting the clogging suppression mechanism is provided in a first bypass pipe 51. The rotary screw 71 has a rotating shaft that is parallel to the longitudinal direction of the first bypass pipe 51.

The rotary screw 71 is rotated by a motor 72, and accordingly a mist deposited in the first bypass pipe 51 can be sent to the upstream side or the downstream side. This structure prevents fine particles from depositing in the first bypass pipe 51. The device for producing fluorine gas in the eighth alternative embodiment has substantially the same constitution as the device for producing fluorine gas in the second alternative embodiment except the above structure, and thus similar structures are not described.

Ninth Alternative Embodiment

Figure 12:
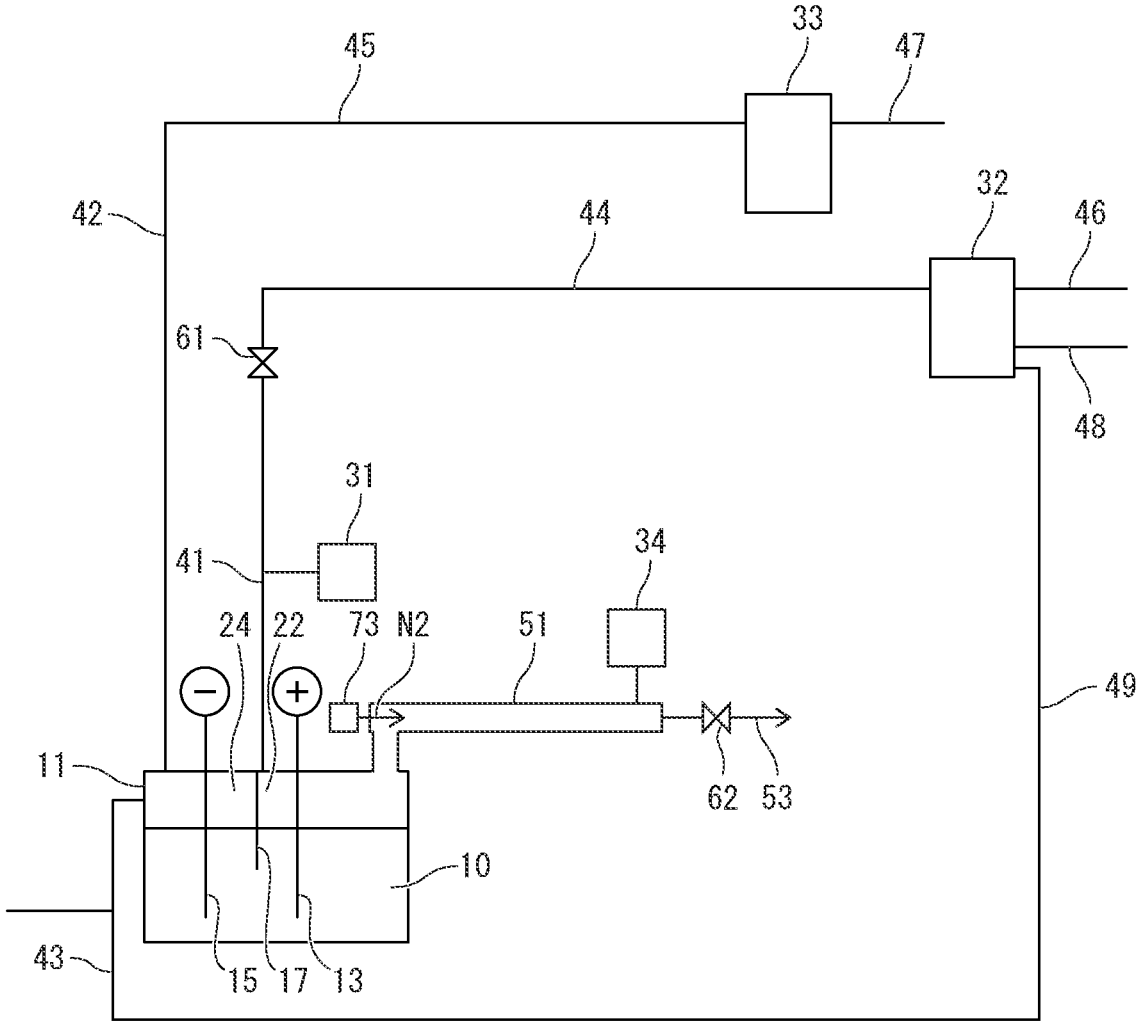
FIG. 12 is a schematic view illustrating a ninth alternative embodiment of the device for producing fluorine gas in FIG. 2.

A ninth alternative embodiment will be described with reference to FIG. 12. A device for producing fluorine gas in the ninth alternative embodiment differs from that in the second alternative embodiment illustrated in FIG. 5 in the clogging suppression mechanism. In the device for producing fluorine gas in the ninth alternative embodiment, an airflow generator 73 constituting the clogging suppression mechanism is provided on a first bypass pipe 51. The airflow generator 73 sends an airflow (for example, a nitrogen gas stream) from the upstream side toward the downstream side in the first bypass pipe 51 and increases the flow rate of an anode gas flowing in the first bypass pipe 51. This structure prevents fine particles from depositing in the first bypass pipe 51.

In the embodiment, the flow rate of an anode gas flowing in the first bypass pipe 51 is preferably 1 m/sec or more and 10 m/sec or less. The flow rate can be increased to more than 10 m/sec, but in such a case, the pipe resistance in the first bypass pipe 51 increases the pressure loss, and the pressure in an anode chamber 22 of an electrolytic cell 11 increases. The pressure in the anode chamber 22 and the pressure in a cathode chamber 24 are preferably substantially the same. If the difference between the pressure in the anode chamber 22 and the pressure in the cathode chamber 24 were excessively large, an anode gas could go over a partition wall 17 and flow into the cathode chamber 24, and fluorine gas could be reacted with hydrogen gas to impair fluorine gas generation.

The device for producing fluorine gas in the ninth alternative embodiment has substantially the same constitution as the device for producing fluorine gas in the second alternative embodiment except the above structure, and thus similar structures are not described.

Tenth Alternative Embodiment

Figure 13:
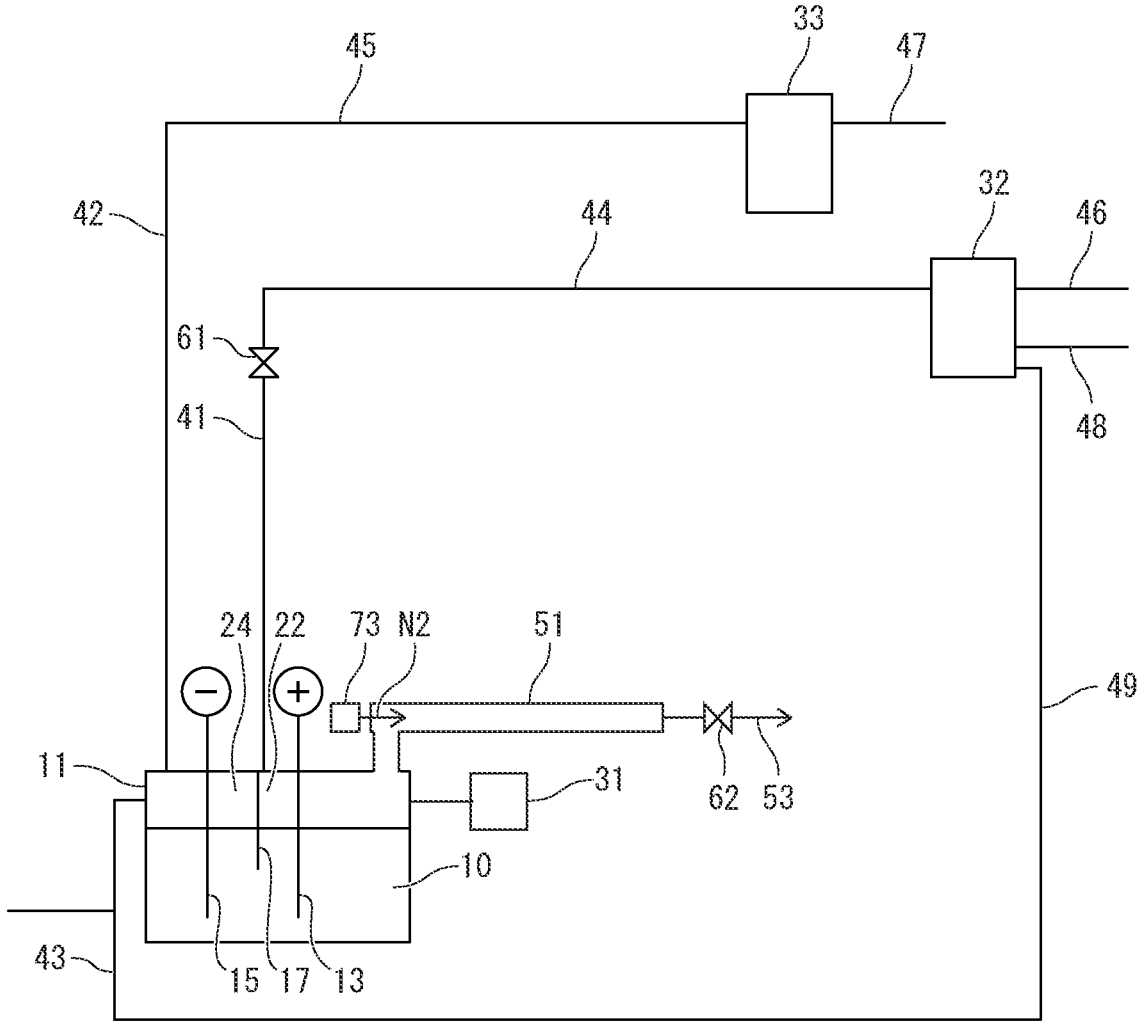
FIG. 13 is a schematic view illustrating a tenth alternative embodiment of the device for producing fluorine gas in FIG. 2.

A tenth alternative embodiment will be described with reference to FIG. 13. In a device for producing fluorine gas in the tenth alternative embodiment, a first average particle size measurement unit 31 is provided on an electrolytic cell 11, and the average particle size of a mist is measured by introducing the anode gas in the electrolytic cell 11 directly into the first average particle size measurement unit 31. The device for producing fluorine gas in the tenth alternative embodiment has no second average particle size measurement unit 34. The device for producing fluorine gas in the tenth alternative embodiment has substantially the same constitution as the device for producing fluorine gas in the ninth alternative embodiment illustrated in FIG. 12 except the above structure, and thus similar structures are not described.

EXAMPLES

The present invention will next be described more specifically with reference to examples and comparative examples.

Reference Example 1

An electrolyte was electrolyzed to produce fluorine gas. As the electrolyte, a mixed molten salt (560 L) of 434 kg of hydrogen fluoride and 630 kg of potassium fluoride was used. As the anode, 16 amorphous carbon electrodes manufactured by SGL Carbon (30 cm in width, 45 cm in length, and 7 cm in thickness) were placed in an electrolytic cell. As the cathode, punching plates formed from Monel (trademark) were placed in the electrolytic cell. One anode faced two cathodes, and portions of one anode facing the cathodes had a total area of 1,736 $cm^2$.

The electrolysis temperature was controlled at 85 to 95° C. First, the temperature of the electrolyte was set at 85° C., and a direct current of 1,000 A was applied at a current density of 0.036 $A/cm^2$ to start electrolysis. At the start, the electrolyte had a water concentration of 1.0% by mass. The water concentration was measured by Karl Fischer analysis method.

Electrolysis was started in the above conditions, and for 10 hours from the start of the electrolysis, small explosive sound was observed near the anodes in the anode chamber. The explosive sound is supposed to be caused by reaction of fluorine gas generated and water in the electrolyte.

The fluid generated on the anodes at this stage was collected when sent out from the anode chamber of the electrolytic cell to the outside, and the mist contained in the fluid was analyzed. As a result, 1 L of the fluid generated on the anodes contained 5.0 to 9.0 mg of fine particles (calculated assuming that the mist has a specific gravity of 1.0 g/mL, hereinafter the same is applied), and the fine particles had an average particle size of 1.0 to 2.0 μm. The fine particles were observed under an optical microscope, and particles having a hollow spherical shape were mainly observed. At this stage, the current efficiency of fluorine gas production was 0 to 15%.

The electrolysis continued until the electric energy reached 30 kAh, and the frequency of explosive sound in the anode chamber was reduced. At this stage, the electrolyte had a water concentration of 0.7% by mass. The fluid generated on the anodes at this stage was collected when sent out from the anode chamber of the electrolytic cell to the outside, and the mist contained in the fluid was analyzed. As a result, 1 L of the fluid generated on the anodes contained 0.4 to 1.0 mg of a mist, and the mist had an average particle size of 0.5 to 0.7 μm. At this stage, the current efficiency of fluorine gas production was 15 to 55%. The step of electrolysis from the start of electrolysis to this stage is regarded as "step (1)".

Following the step (1), the electrolyte was continuously electrolyzed. Accordingly, hydrogen fluoride was consumed, and the level of the electrolyte was reduced. Hence, hydrogen fluoride was appropriately resupplied from a hydrogen fluoride tank into the electrolytic cell. The hydrogen fluoride to be resupplied had a water concentration of 500 ppm by mass or less.

When the electrolysis was continued until the electric energy reached 60 kAh, the mist contained in the fluid generated on the anodes had an average particle size of 0.36 μm (i.e., 0.4 μm or less). At this stage, absolutely no explosive sound was observed in the anode chamber. At this stage, the electrolyte had a water concentration of 0.2% by mass (i.e., 0.3% by mass or less). At this stage, the current efficiency of fluorine gas production was 65%. The step of electrolysis from the end of the step (1) to this stage is regarded as "step (2)".

Figure 14:
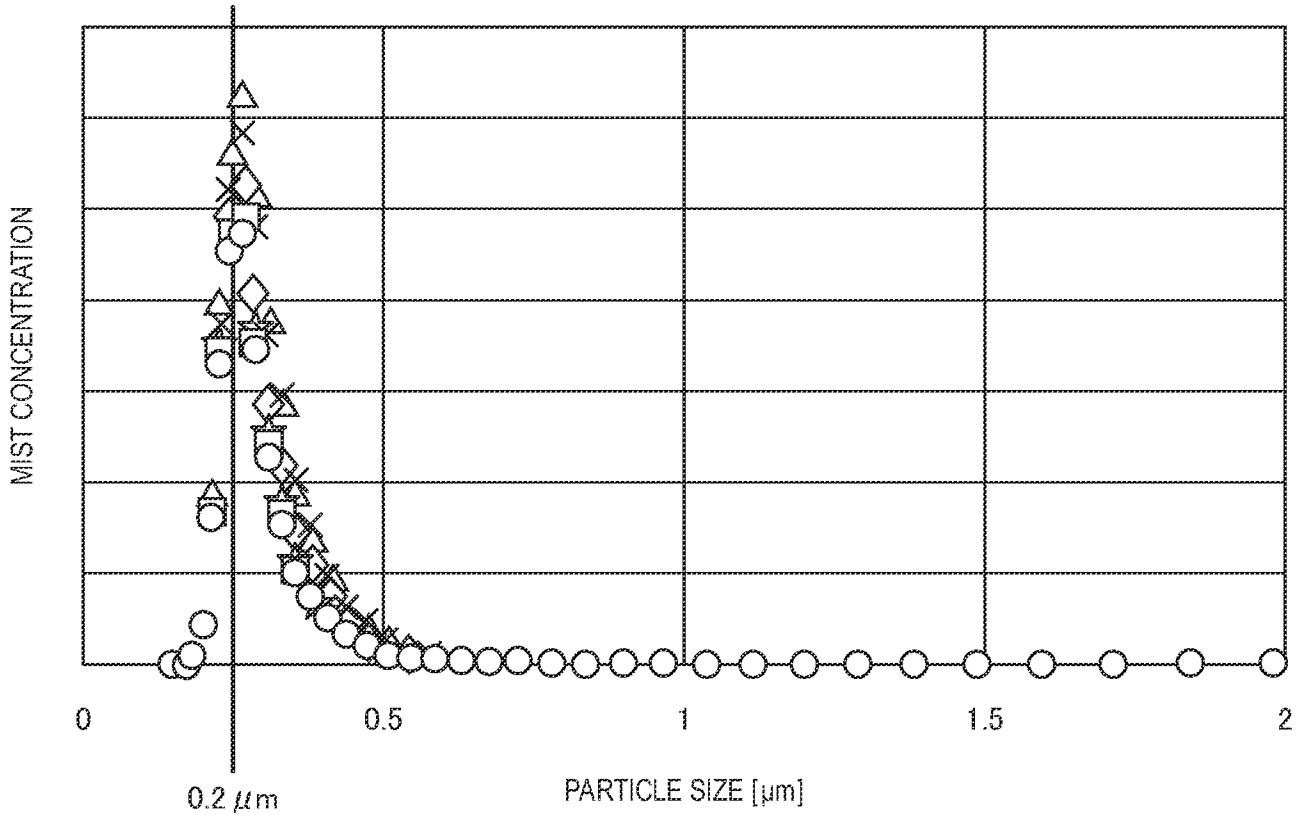
FIG. 14 is a graph illustrating a particle size distribution of a mist contained in a fluid generated on the anode in Reference Example 1.

Following the step (2), the current was increased to 3,500 A to increase the current density to 0.126 A/cm$^2$, and the electrolyte was continuously electrolyzed. The fluid generated on the anodes at this stage was collected when sent out from the anode chamber of the electrolytic cell to the outside, and the mist contained in the fluid was analyzed. As a result, 1 L of the fluid generated on the anodes contained 0.03 to 0.06 mg of fine particles, and the fine particles had an average particle size of about 0.2 μm (0.15 to 0.25 μm) with a particle size distribution of about 0.1 to 0.5 μm. FIG. 14 illustrates the measurement result of particle size distribution of the fine particles. At this stage, the current efficiency of fluorine gas production was 94%. The step of electrolysis from the end of the step (2) to this stage is regarded as "stable step".

Details of the electrolysis performed as above in Reference Example 1 are summarized in Table 1. Table 1 illustrates electric current, electrolysis time, electric energy, the water concentration in an electrolyte, the mass of a mist contained in 1 L of a fluid generated on the anodes ("anode gas" in Table 1), the average particle size of a mist, current efficiency, the amount of a fluid (containing fluorine gas, oxygen gas, and a mist) generated on the anodes, the amount of a mist generated on the anodes, the intensity of explosive sound, and the water concentration in a fluid formed on the cathodes (the water concentration in a cathode gas" in Table 1).

Figure 15:
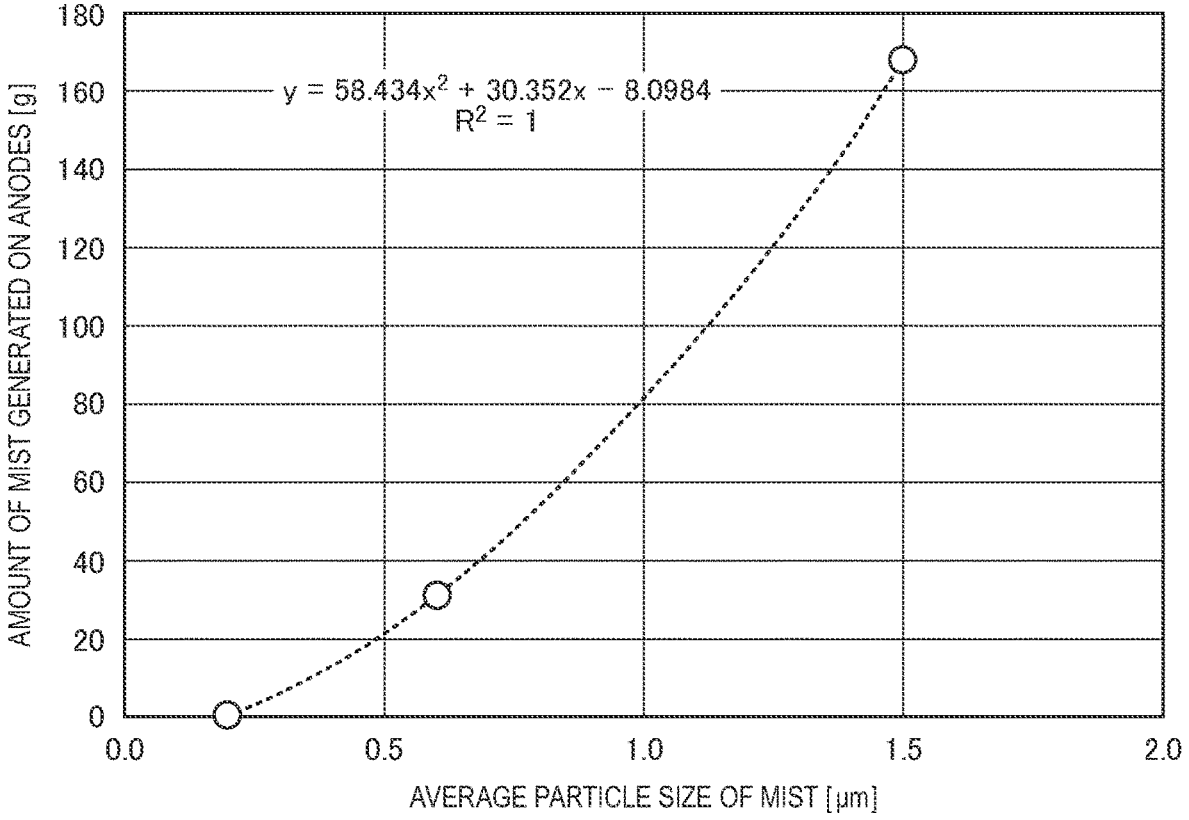
FIG. 15 is a graph illustrating a relation between average particle size of a mist and amount of the mist generated on the anode in Reference Example 1.

A graph representing the relation between average particle size of a mist and amount of the mist generated on the anodes is illustrated in FIG. 15. The graph in FIG. 15 reveals that the average particle size of a mist has a relation to the amount of a mist generated on the anodes. As the amount of a mist generated increases, the clogging of pipes and valves is more frequently caused. When a mist having an average particle size of more than 0.4 μm is generated, the amount of a mist generated increases, and the mist is settled by gravity. The relation represented by the graph in FIG. 15 therefore illustrates a relation between the average particle size of a mist and likelihood of clogging of pipes and valves.

Figure 16:
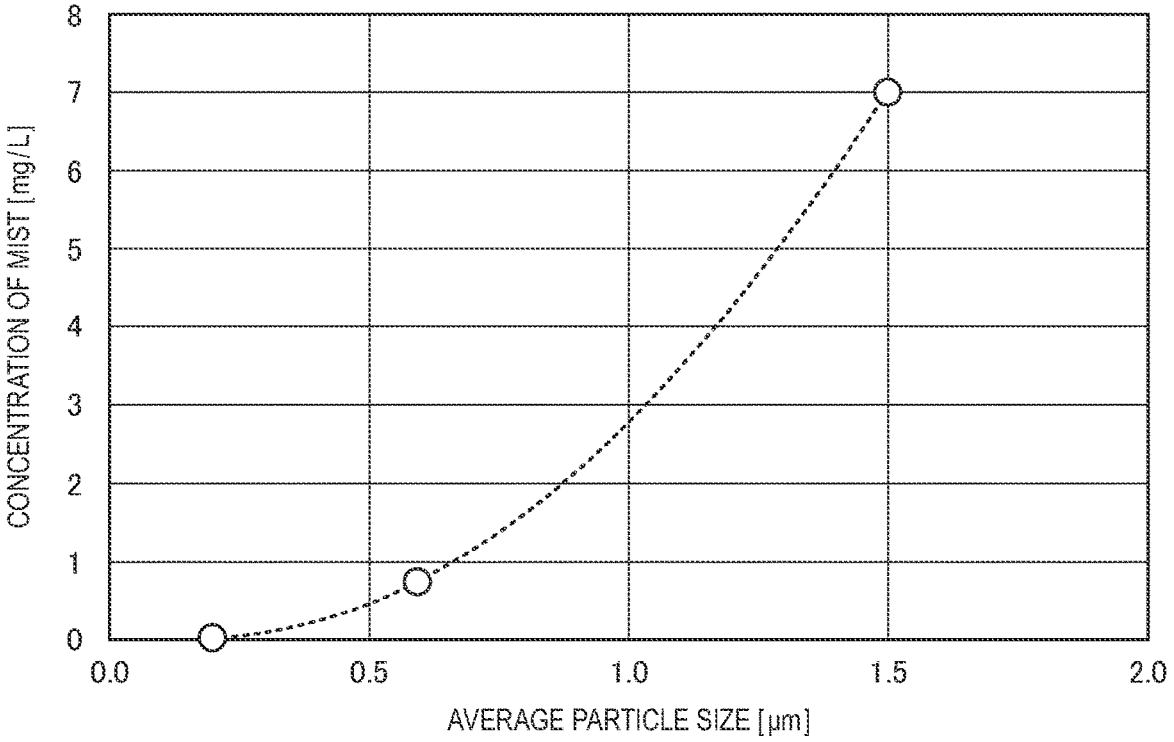
FIG. 16 is a graph illustrating a relation between average particle size of a mist and concentration of the mist contained in a fluid generated on the anode in Reference Example 1.

A graph representing the relation between concentration of a mist contained in the fluid generated on the anode (the mass of a mist in 1 L of a fluid (unit: mg/L)) and average particle size of the mist is illustrated in FIG. 16. As the amount of a mist contained in a fluid increases, the clogging of pipes and valves is more frequently caused. The relation represented by the graph in FIG. 16 therefore illustrates a relation between the average particle size of a mist and likelihood of clogging of pipes and valves.

TABLE 1

| | Electrolysis | | | Water | Mist in anode gas | | | Intensity of | Water |
|---|---|---|---|---|---|---|---|---|---|
| Step | Electric current (A) | Elapsed time (h) | Electric energy (kAh) | concentration in electrolyte (% by mass) | Amount (mg/L) | Average particle size (mm) | Current efficiency (%) | explosive sound (dB) | concentration in cathode gas (% by volume) |
| Step (1) | 1000 | 0-30 | 0-30 | 1.0 | 5.0-9.0 | 1.0-2.0 | 0-15 | 50-70 | 0.10 |
| Step (1) | 1000 | 30 | 30 | 0.7 | 0.4-1.0 | 0.5-0.7 | 15-55 | 25-35 | 0.07 |
| Step (2) | 1000 | 60 | 60 | 0.2 | not measured | 0.36 | 65 | 15-30 | 0.02 |
| Stable step | 3500 | 65 | 77.5 | less than 0.2 | 0.03-0.06 | 0.15-0.25 | 94 | 2-5 | not measured |

Example 1

Electrolysis was performed in the same manner as in Reference Example 1 using the device for producing fluorine gas illustrated in FIG. 2. In the electrolysis in the step (1), the fluid generated on the anodes was allowed to flow through the second bypass pipes, the bypass valves, and the first bypass pipe. After the completion of electrolysis in the step (1), the electrolysis was once stopped, and the inside of the device for producing fluorine gas was inspected. As a result, a mist deposited in the first bypass pipe, but the first bypass pipe had a large pipe diameter, and thus the pipe was not clogged.

The electrolysis reached the step (2) where the mist had an average particle size of 0.4 μm or less (0.36 μm), and thus the fluid generated on the anodes was allowed to flow through the first pipes, the first pipe valves, the fourth pipe, and the first mist removal unit. Neither mist deposition nor clogging was caused in the first pipes, the first pipe valves, or the fourth pipe, but the fluid generated on the anodes was fed to the first mist removal unit, and the mist was removed by the first mist removal unit. The first mist removal unit was a scrubber type mist remover that sprayed liquid hydrogen fluoride to remove microparticles such as a mist and had a mist removal rate of 98% or more.

Comparative Example 1

Electrolysis was performed in the same manner as in Example 1 except that the fluid generated on the anodes in the electrolysis in the step (1) was allowed to flow through the first pipes, the first pipe valves, the fourth pipe, and the first mist removal unit.

During the electrolysis in the step (1), of pressure gauges attached to the anode side and the cathode side of the electrolytic cell, the measured value of the pressure gauge at the anode side gradually increased, and the differential pressure from the pressure at the cathode side reached 90 $mmH_2O$. The electrolysis was thus stopped. The reason for the stop is described below. Of the partition wall in the electrolytic cell, a portion immersed in the electrolyte had a vertical length (immersion depth) of 5 cm. If the pressure at the anode side were higher than the pressure at the cathode side by about 100 $mmH_2O$, the surface of the electrolyte at the anode side would be below the lower end of the partition wall. As a result, fluorine gas could flow over the partition wall and be mixed with hydrogen gas at the cathode side to suddenly cause dangerous reaction between fluorine gas and hydrogen gas.

After the system was purged with nitrogen gas or the like, the insides of the first pipes, the first pipe valves, and the fourth pipe were inspected. The first pipes were not clogged because the pipes extended in the vertical direction. Deposition of a small amount of fine particles was observed in the first pipe valves, and the inlet portions to the downstream pipe of the first pipe valves, or to the fourth pipe, were clogged with fine particles. Deposition of fine particles was also observed in the fourth pipe, but the deposition was such a small amount as not to clog the pipe.

REFERENCE SIGNS LIST

1 sample chamber
2 light source
3 scattered light detection unit
4A, 4B transparent window
10 electrolyte
11 electrolytic cell
13 anode
15 cathode
22 anode chamber
24 cathode chamber
31 first average particle size measurement unit
32 first mist removal unit
33 second mist removal unit
34 second average particle size measurement unit
41 first pipe
42 second pipe
43 third pipe
44 fourth pipe
45 fifth pipe
46 sixth pipe
47 seventh pipe
48 eighth pipe
49 ninth pipe
51 first bypass pipe
52 second bypass pipe
61 first pipe valve
62 bypass valve
F fluid
L light for light scattering measurement
M mist
S scattered light

The invention claimed is:

1. A method for producing fluorine gas, the fluorine gas being produced by electrolyzing an electrolyte containing hydrogen fluoride and a metal fluoride, the method comprising:

electrolyzing the electrolyte in an electrolytic cell;

measuring an average particle size of a mist contained in a fluid generated in an inside of the electrolytic cell in the electrolyzing the electrolyte; and sending the fluid from the inside to an outside of the electrolytic cell through a flow path, wherein in the sending, the flow path in which the fluid flows is switched in accordance with the average particle size of the mist measured in the measuring an average particle size, such that the fluid is sent to a first flow path that sends the fluid from the inside of the electrolytic cell to a first outside when the average particle size of the mist measured in the measuring an average particle size is not more than a predetermined reference value, or the fluid is sent to a second flow path that sends the fluid from the inside of the electrolytic cell to a second outside when the average particle size is more than the predetermined reference value, and the predetermined reference value is a numerical value of 0.1 μm or more and 1.0 μm or less.

2. The method for producing fluorine gas according to claim 1, wherein the metal fluoride is a fluoride of at least one metal selected from the group consisting of potassium, cesium, rubidium, and lithium.

3. The method for producing fluorine gas according to claim 1, wherein an anode used in the electrolyzing is a carbonaceous electrode formed from at least one carbon material selected from the group consisting of diamond, diamond-like carbon, amorphous carbon, graphite, and glassy carbon.

4. The method for producing fluorine gas according to claim 1, wherein the electrolytic cell has a structure in which bubbles generated on an anode or a cathode used in the electrolyzing are capable of rising vertically in the electrolyte to reach a surface of the electrolyte.

5. A device for producing fluorine gas, the fluorine gas being produced by electrolysis of an electrolyte containing hydrogen fluoride and a metal fluoride, the device comprising:

an electrolytic cell storing the electrolyte and configured to perform the electrolysis;

an average particle size measurement unit configured to measure an average particle size of a mist contained in a fluid generated in an inside of the electrolytic cell during the electrolysis of the electrolyte, and a flow path configured to send the fluid from the inside to an outside of the electrolytic cell, wherein the flow path includes a first flow path configured to send the fluid from the inside of the electrolytic cell to a first outside and a second flow path configured to send the fluid from the inside of the electrolytic cell to a second outside and includes a flow path switching unit configured to switch the flow path in which the fluid flows, to the first flow path or the second flow path in accordance with the average particle size of the mist measured by the average particle size measurement unit, the flow path switching unit is configured to send the fluid from the inside of the electrolytic cell to the first flow path when the average particle size of the mist measured by the average particle size measurement unit is not more than a predetermined reference value, or to send the fluid from the inside of the electrolytic cell to the second flow path when the average particle size is more than the predetermined reference value, and the predetermined reference value is a numerical value of 0.1 μm or more and 1.0 μm or less.

6. The method for producing fluorine gas according to claim 2, wherein an anode used in the electrolyzing is a carbonaceous electrode formed from at least one carbon material selected from the group consisting of diamond, diamond-like carbon, amorphous carbon, graphite, and glassy carbon.

7. The method for producing fluorine gas according to claim 2, wherein the electrolytic cell has a structure in which bubbles generated on an anode or a cathode used in the electrolyzing are capable of rising vertically in the electrolyte to reach a surface of the electrolyte.

8. The method for producing fluorine gas according to claim 3, wherein the electrolytic cell has a structure in which bubbles generated on the anode or a cathode used in the electrolyzing are capable of rising vertically in the electrolyte to reach a surface of the electrolyte.

* * * * *